US011559141B2

(12) United States Patent
Takeya et al.

(10) Patent No.: US 11,559,141 B2
(45) Date of Patent: Jan. 24, 2023

(54) CHAIR

(71) Applicant: ITOKI CORPORATION, Osaka (JP)

(72) Inventors: Yuki Takeya, Osaka (JP); Kensuke Takahashi, Osaka (JP); Ryogo Morita, Osaka (JP); Minoru Hashimoto, Osaka (JP)

(73) Assignee: ITOKI CORPORATION, Osaka (JP)

( * ) Notice: Subject to any disclaimer, the term of this patent is extended or adjusted under 35 U.S.C. 154(b) by 6 days.

(21) Appl. No.: 16/998,200

(22) Filed: Aug. 20, 2020

(65) Prior Publication Data

US 2021/0059416 A1 Mar. 4, 2021

(30) Foreign Application Priority Data

Aug. 30, 2019 (JP) ..... JP2019-158698

(51) Int. Cl.

| | |
|---|---|
| ***A47C 3/021*** | (2006.01) |
| ***A47C 7/46*** | (2006.01) |
| ***A47C 7/00*** | (2006.01) |
| ***A47C 7/54*** | (2006.01) |
| ***A47C 7/56*** | (2006.01) |

(52) U.S. Cl.

CPC ..... *A47C 7/46* (2013.01); *A47C 3/021* (2013.01); *A47C 7/004* (2013.01); *A47C 7/006* (2013.01); *A47C 7/54* (2013.01); *A47C 7/56* (2013.01)

(58) Field of Classification Search

CPC ..... A47C 7/44; A47C 7/444; A47C 7/445; A47C 7/4454; A47C 7/46; A47C 7/48; A47C 1/03; A47C 1/0308; A47C 7/541; A47C 3/021

USPC ..... 297/291, 354.11, 411.32, 411.38, 322, 297/342, 343, 286, 341

See application file for complete search history.

(56) References Cited

U.S. PATENT DOCUMENTS

| | | | | | |
|---|---|---|---|---|---|
| 293,813 | A | * | 2/1884 | St. John | A47C 3/021 297/296 X |
| 1,256,726 | A | * | 2/1918 | Pike | A47C 3/12 297/411.41 |
| D62,102 | S | * | 3/1923 | Gillam | 297/411.41 |
| D95,745 | S | * | 5/1935 | Hoffman | 297/411.4 |
| 2,034,412 | A | * | 3/1936 | Neutra | A47C 3/021 297/287 X |

(Continued)

FOREIGN PATENT DOCUMENTS

| | | | | |
|---|---|---|---|---|
| DE | 202015006276 U1 | * | 9/2015 | A47C 3/023 |
| JP | S61-129557 U | | 8/1986 | |

(Continued)

OTHER PUBLICATIONS

Extended European Search Report dated Sep. 28, 2020 in corresponding European Patent Application No. 20191718.4.

*Primary Examiner* — Rodney B White

(74) *Attorney, Agent, or Firm* — Faegre Drinker Biddle & Reath LLP

(57) ABSTRACT

A chair includes, a seat, a backrest separated from the seat, and an upper support frame to which the backrest is attached at a position higher than the seat. In the chair, the upper support frame includes a left side portin and a right side portions both extending forward at left and right sides of the seated person and a rear portion that continuously and integrally connects the left side portion and the right side portion. The left side portion and the right side portion are connected to side support bodies arranged on left and right sides of the seat to be tiltable, and the backrest is connected to the upper support frame to be tiltable rearward.

4 Claims, 24 Drawing Sheets

(56) References Cited

U.S. PATENT DOCUMENTS 2,035,489 A * 3/1936 McArthur, Jr. ..... 403/174
2,063,781 A * 12/1936 Ball ..... A47C 3/021 297/286
2,085,804 A * 7/1937 Heimann ..... A47C 5/046 297/411.4
D108,877 S * 3/1938 Johnson ..... D6/373
D147,935 S * 11/1947 Sundberg ..... D6/373
D155,727 S * 10/1949 Paden ..... 297/411.42
D161,729 S * 1/1951 Bascom ..... 297/447.4
D177,072 S * 3/1956 Smilow ..... 297/411.42
2,838,095 A * 6/1958 Deaton ..... A47C 7/443 297/301.4
D194,741 S * 3/1963 Deaton ..... D6/366
3,087,758 A * 4/1963 Deaton ..... A47C 7/002 297/440.22
3,148,914 A * 9/1964 Steely ..... A47D 15/006 297/411.4 X
D202,548 S * 10/1965 Kramer ..... 297/411.4
3,309,136 A * 3/1967 Kehoe ..... A47B 91/08 297/411.4 X
3,328,084 A * 6/1967 Whitener ..... A47C 7/002 297/411.41
3,361,472 A * 1/1968 Hasbrouck ..... A47C 1/0246 297/411.41 X
3,847,433 A * 11/1974 Acton ..... A47C 1/124 297/239
4,429,917 A * 2/1984 Diffrient ..... A47C 1/03266 297/300.5
4,641,885 A * 2/1987 Brauning ..... A47C 1/03277 297/292 X
4,783,121 A * 11/1988 Luyk ..... A47C 3/026 297/300.2
4,786,106 A * 11/1988 Bottemiller ..... A47C 3/0252 297/265.1
4,840,426 A * 6/1989 Vogtherr ..... A47C 1/03266 297/300.5
4,861,108 A * 8/1989 Acton ..... A47C 1/12 297/354.11 X
4,877,291 A * 10/1989 Taylor ..... A47C 1/03283 297/322
4,889,385 A * 12/1989 Chadwick ..... A47C 7/441 297/285 X
4,911,501 A * 3/1990 Decker ..... A47C 1/03255 297/354.11 X
5,009,466 A 4/1991 Perry
5,009,467 A * 4/1991 McCoy ..... A47C 1/03 297/411.36
5,112,108 A * 5/1992 Zapf ..... A47C 7/445 297/291
5,275,465 A * 1/1994 Gulliver ..... A47C 7/70 297/411.32 X
5,318,346 A * 6/1994 Roossien ..... A47C 3/12 297/300.1 X
5,338,094 A 8/1994 Perry
5,383,712 A 1/1995 Perry
5,476,304 A * 12/1995 Gulliver ..... G06F 3/0202 297/411.33 X
5,547,253 A * 8/1996 Schwartz ..... A47C 7/402 297/411.4 X
5,630,643 A * 5/1997 Scholten ..... A47C 3/12 297/218.2
5,678,896 A * 10/1997 Chung ..... A47C 1/03 297/411.32
5,810,438 A * 9/1998 Newhouse ..... A47C 5/12 297/286
5,887,946 A * 3/1999 Raftery ..... A47C 7/445 297/297
RE36,335 E 10/1999 Perry
6,070,937 A * 6/2000 Ginat ..... A47C 7/445 297/285
6,109,694 A * 8/2000 Kurtz ..... A47C 1/03255 297/320
6,120,097 A * 9/2000 Perry ..... A47C 3/12 297/354.11 X
6,164,725 A * 12/2000 Santa Cruz ..... B60N 2/787 297/411.4 X
6,196,632 B1 * 3/2001 De Lucchi ..... A47C 5/06 297/451.1
6,296,309 B1 * 10/2001 Kurtz ..... A47C 3/12 297/297
6,460,928 B2 * 10/2002 Knoblock ..... A47C 1/03274 297/284.4
6,523,895 B1 * 2/2003 Vogtherr ..... A47C 1/024 297/291
6,523,898 B1 * 2/2003 Ball ..... A47C 1/0305 297/320
6,685,267 B1 * 2/2004 Johnson ..... A47C 1/023 297/300.1
6,783,180 B1 * 8/2004 Young ..... A47C 1/024 297/302.1
7,185,951 B2 * 3/2007 Johnson ..... A47C 1/023 297/300.2
7,188,900 B1 * 3/2007 Raftery ..... A47C 1/03255 297/286
7,234,775 B2 * 6/2007 Serber ..... A47C 1/022 297/301.1
7,267,405 B2 * 9/2007 Tin ..... A47C 1/03255 297/300.1
7,278,688 B1 * 10/2007 Hung ..... A47C 7/402 297/285 X
7,311,361 B2 * 12/2007 Hung ..... A47C 7/543 297/411.44
7,380,881 B2 * 6/2008 Freed ..... A47C 9/002 297/337
7,427,105 B2 * 9/2008 Knoblock ..... A47C 1/03274 297/284.4
7,427,107 B2 * 9/2008 Yang ..... A47C 7/448 297/291 X
7,625,045 B2 * 12/2009 Hatcher ..... A47C 1/03277 297/300.2
7,896,439 B2 * 3/2011 Kan ..... A47C 3/021 297/291 X
D648,962 S * 11/2011 Brodbeck ..... D6/709.2
D648,963 S * 11/2011 Brodbeck ..... D6/716
10,321,763 B2 * 6/2019 Bonneywell ..... A47C 7/44
10,667,612 B2 * 6/2020 Matlin ..... A47C 7/006
2002/0190555 A1 * 12/2002 Holbrook ..... A47C 7/44 297/300.4
2003/0127896 A1 * 7/2003 Deimen ..... A47C 7/46 297/301.1
2003/0137171 A1 * 7/2003 Deimen ..... A47C 3/18 297/284.1
2005/0104435 A1 * 5/2005 Bain ..... A47C 1/03 297/411.36
2005/0275265 A1 12/2005 Deimen et al.
2006/0238006 A1 * 10/2006 Baranov ..... A47C 7/50 297/284.3
2006/0244294 A1 * 11/2006 Dozsa-Farkas .... A47C 1/03283 297/300.2
2017/0245643 A1 8/2017 Schneider
2020/0178690 A1 * 6/2020 Matlin ..... A47C 7/40

FOREIGN PATENT DOCUMENTS

JP H04-9863 Y2 3/1992
JP H09-502631 A 3/1997
JP 2011-136203 A 7/2011
JP 4950486 B2 6/2012
JP 1627516 S 3/2019
KR 20080005743 U * 11/2008 ..... A47C 7/48
KR 2010-0009554 U 9/2010
KR 20120118575 A * 10/2012 ..... A47C 7/44
KR 1588709 B1 * 2/2016 ..... A47C 7/445
WO WO-8910080 A1 * 11/1989 ..... A47C 7/405

* cited by examiner

CHAIR

TECHNICAL FIELD

The present invention relates to a chair having a rocking function.

BACKGROUND ART

There are many different chair structures that can be classified according to various criteria. As one criterion, they can be classified according to whether or not a backrest has a rocking function. In the case of a simple structure called a pipe chair, the chair often does not have a rocking ability. In such a chair having no rocking function, it is known that the backrest is fixed to a rear portion of an upper support frame which surrounds a seated person from behind.

On the other hand, it has been proposed that a backrest has a rocking function even with a simple structure. As an example thereof, a microfilm of JP-UM-A-1986-129557 discloses that a backrest is connected to rear ends of side frames arranged on both left and right sides of a seat to be able to tilt backward. In the known example, the side frame has a hollow structure and a leaf spring which gives resistance to the backward tilting of the backrest is arranged in an inner portion of the side frame.

JP-UM-B-1992-9863 discloses that in a four-legged chair, a backrest is connected to left and right back struts standing upright from the rear of a seat to be tiltable backward. In JP-UM-B-1992-9863, the back strut is made of a pipe and a spring which gives resistance to backward tilting of the backrest is arranged inside the back strut.

Design Registration No. 1627516 discloses that an arm is connected to upper ends of side struts which are erected on both left and right sides of a seat to be tiltable backward and a backrest is fixed to rear ends of the left and right arms. Conversely, in Design Registration No. 1627516, the left and right arms are provided to protrude forward on the backrest and the front ends of the arms are connected to the side struts to be tiltable backward. It is presumed that a spring which gives resistance to rocking is built in a connecting portion between the arm and the side strut. In Design Registration No. 1627516, the seat is integrally connected to the arm, and when the arm tilts backward, the seat also tilts backward.

Chairs described in JP-A-2011-136203 and JP-T-1997-502631 are provided with an upper support frame which surrounds a seated person from behind, and when a backrest is attached to a rear portion of the upper support frame, the upper support frame is composed of a plurality of pieces and the bending deformation of the plurality of upper support frames is used to allow the backward tilting of the backrest.

SUMMARY OF INVENTION

Since the configurations of JP-A-2011-136203 and JP-T-1997-502631 require a plurality of upper support frames, it cannot be said that the user's demand for simplicity can be met, and it can be said that the versatility is low.

Since the rocking function is given to the backrest by utilizing the bending of the frame material, there is a possibility that the backrest swings easily and it can be said that there is a problem in versatility also here.

On the other hand, JP-UM-A-1986-129557, JP-UM-B-1992-9863, and Design Registration No. 1627516 can be said to have high versatility because they have a simple appearance and there is no backrest swinging motion. In either case, the back tilt angle of the backrest cannot be made extremely large due to the constraint of a space of a connecting portion, and therefore, it can be said that the comfort for a user is limited. In the chairs of JP-UM-A-1986-129557, JP-UM-B-1992-9863, and Design Registration No. 1627516, since the backrest is connected to the support members independently arranged on the left and right, it is considered that the rigidity of the chair as a whole is not high.

The invention has been made based on such a current situation and an object thereof is to provide an improved chair which has a simple appearance and is excellent in strength and a rocking function. The present application includes many improved techniques which can be independent inventions and providing those improved techniques can be a problem.

(1) According to an aspect of the invention, a chair includes:

a seat;

a backrest separated from the seat; and an upper support frame to which the backrest is attached at a position higher than the seat, wherein the upper support frame includes:

a left side portin and a right side portions both extending forward at left and right sides of the seated person; and a rear portion that continuously and integrally connects the left side portion and the right side portion, the left side portion and the right side portion are connected to side support bodies arranged on left and right sides of the seat to be tiltable, and the backrest is connected to the upper support frame to be tiltable rearward.

(2) In the chair according to the configuration (1), the left and right side support bodies have a T-shape or an L-shape in a side view and have a front-rear longitudinal upper horizontal portion and an upper-lower longitudinal strut portion, and the upper horizontal portion is set to a height at which a seated person's elbow is placable.

(3) In the chair according to the configuration (1) or (2), the backrest is connected to the rear portion of the upper support frame.

(4) In the chair according to any one of the configurations (1) to (3), resistance when the backrest tilts rearward relative to the upper support frame is set to be larger than resistance when the upper support frame tilts relative to the side support body.

(5) In the chair according to any one of the configurations of (1) to (4), the backrest is connected to the upper support frame at a position lower than an upper-lower intermediate position of the backrest.

(6) In the chair according to any one of the configurations (1) to (5), the seat is attached to a seat receiving member so that it can be pushed forward by a seated person when rocking.

(7) According to another aspect of the invention, a chair includes:

a seat;

a backrest that is separated from the seat; and an upper support frame to which the backrest is attached at a position higher than the seat are provided, wherein the upper support frame includes:

a left side portion and a right side portion both extending forward on left and right sides of the seated person; and a rear portion that continuously and integrally connects the left side portion and the right side portion, and the left side portion and the right side portion are connected to at least one of the seat, a seat receiving member supporting the seat, and a base supporting the seat receiving member to be tiltable, and the backrest is connected to the upper support frame to be tiltable rearward.

In the present invention, the leg device can adopt various forms. For example, a configuration including a pedestal formed of a gas cylinder can be adopted. That is, it can be applied to a swivel chair. Alternatively, it can be applied to a non-rotating chair such as a four-legged type.

Effect of Configuration (1)

In the invention, the upper support frame has a structure in which the left and right side portions and the rear portion are integrally connected, and thus has high rigidity as a whole. Therefore, the backrest can be stably supported in a state of smoothly tilting without making the upper support frame excessively thick.

Then, the backrest tilts backward (downward) as a whole by the backward tilting of the upper support frame and tilts backward with respect to the upper support frame, so that the backward tilt angle as a whole can be increased. That is, the invention has a double rocking system including two front and rear pivoting fulcrums, so that the rocking angle as a whole can be increased even though each rocking angle has a limit. Therefore, it is possible to provide a user with high comfort while having a simple appearance.

For example, in a configuration in which the backrest tilts backward as in JP-UM-A-1986-129557, JP-UM-B-1992-9863, when the back tilt angle of the backrest increases, the seated person's head moves largely backward. Therefore, it is easy for people passing behind to get in the way, or when the chairs are lined up front and back, it is easy for people sitting behind them to get in the way.

On the contrary, in the invention, the connecting portion of the upper support frame to the side support body and the connecting portion of the backrest to the upper support frame are deviated in the front and rear. Therefore, the overall back tilt angle of the backrest can be increased without unduly increasing the back tilt angle of the backrest relative to the upper support frame. Therefore, even when the seated person does not move his or her head backwards largely, high comfort can be realized. As a result, high comfort can be secured without disturbing the person sitting behind.

As the rocking posture of the seated person, there are a case where, in order to get a rest state, the seated person leans backwards with the face up and the upper body bent backwards and a case where the seated person leans backwards in a state where the seated person pulls the chin and keeps the face facing forward, for example, when the seated person leans backward while looking at a monitor on a desk. In the invention, by tilting the backrest backward with respect to the upper support frame together with the tilt of the upper support frame, the former request can be met and the latter requirement can be met by tilting only the upper support frame.

When the pivoting fulcrum of the upper support frame is located below the seat, there is a phenomenon in which the backrest moves away from seat due to the backward tilt of the upper support frame. Therefore, so-called shirt rolling phenomenon easily occurs due to relative slippage between the seated person's body and the backrest. In the invention, since the pivoting fulcrum of the upper support frame is located at a position higher than the seat, the backrest does not retract due to the tilt of the upper support frame, and thus the shirt rolling phenomenon can be prevented.

As described above, when pivoting fulcrum of the upper support frame is located above the seat, the backrest does not recede, so the amount of the seated person's body receding backward during rocking decreases. Therefore, when the chairs are lined up front and back, when rocking, the seated person's body can be more accurately prevented from annoying the person behind by bending backwards. It can be said that it is easy for women to use because it can obtain a high rocking state without bending the body backward.

Effect of Configuration (2)

When the configuration (2) is adopted, when sitting on the chair or standing up from the chair, the upper horizontal portion of the side support body can be grasped by hand to support the body. Alternatively, the upper horizontal portion of the side support body can be made to function as an elbow pad. Therefore, it is user-friendly.

Effect of Configuration (3)

The backrest can be connected to the side portion of the upper support frame, but in this case, the left and right side parts of the backrest are connected to the upper support frame, so the load of the seated person acting on the backrest acts as a bending force on the pivoting axis of the connecting portion. Therefore, there is a concern that the connecting portion is likely to be twisted.

When the backrest is connected to the rear portion of the upper support frame as in (3), the load acting on the backrest is supported by the rear portion from the rear. Therefore, it is possible to prevent the bending force from acting on the pivoting axis of the connecting portion, and thus high supporting strength can be secured.

Effect of Configuration (4)

When the invention of (4) is adopted, at the time of rocking, the backrest first descends as a whole and then tilts backward. Therefore, the phenomenon that the upper body retreats does not occur at the beginning of rocking, and thus the user does not feel uncomfortable. Therefore, a comfortable rocking state can be realized.

As described above, in the invention, it is possible to select a rest state in which the upper body is bent backward with the face facing upward and a state in which the upper body is tilted backward in a state where the chin is pulled and the face faces forward. In the invention of (4), since the state in which only the upper support frame is tilted can be maintained, it is possible to easily achieve rocking with the face facing the monitor on the desk. Therefore, it is easy to use.

Effect of Configuration (5)

When the pivoting fulcrum of the backrest with respect to the upper support frame is displaced below the upper-lower intermediate positions as in (5), the amount that the lower end of the backrest moves forward with the pivoting decreases. Therefore, the comfort of the seated person can be further improved by eliminating the tense feeling of the body. Since the span from the pivoting fulcrum to the upper end of the backrest becomes large, it is possible to ensure backward tilting of the backrest caused by the seated person bending the body backward.

Effect of Configuration (6)

When the seated person leans against the backrest, the body tends to stretch as a whole. When the pivoting fulcrum of the upper support frame is located above the seat, the upper body does not retreat during rocking, and as a reaction, the lower body tends to move forward.

Here, when the configuration of (6) is adopted, the seat can be pushed forward by the buttocks of the seated person and can move forward, so that extension of the body during rocking can be allowed. As a result, comfort can be further improved. In other words, it is possible to perform rocking without feeling cramped.

Effect of Configuration (7)

The invention of (7) has a double rocking function of the tilt of the upper support frame and the backward tilt of the backrest itself, as in (1), and therefore exhibits substantially the same effect as that of (1).

On the other hand, the invention of (7) is different from (1) in that the pivoting fulcrum of the upper support frame is located at a position lower than the seat surface. In the configuration, rocking causes the backrest to retract, allowing body extension without advancing seat. Therefore, even when the seat is a fixed type, the seated person can be provided with a comfortable easy state.

DESCRIPTION OF EMBODIMENTS

Next, embodiments of the invention will be described with reference to the drawings. In the following, the wording "front-back/left-right" is used to specify the direction, but the direction is based on a state seen by a person who is normally seated in a chair. The front view direction is a direction facing a seated person. First, a first embodiment (main embodiment) illustrated in FIGS. 1A to 23D will be described.

(1) Outline of Chair

Figure 1:
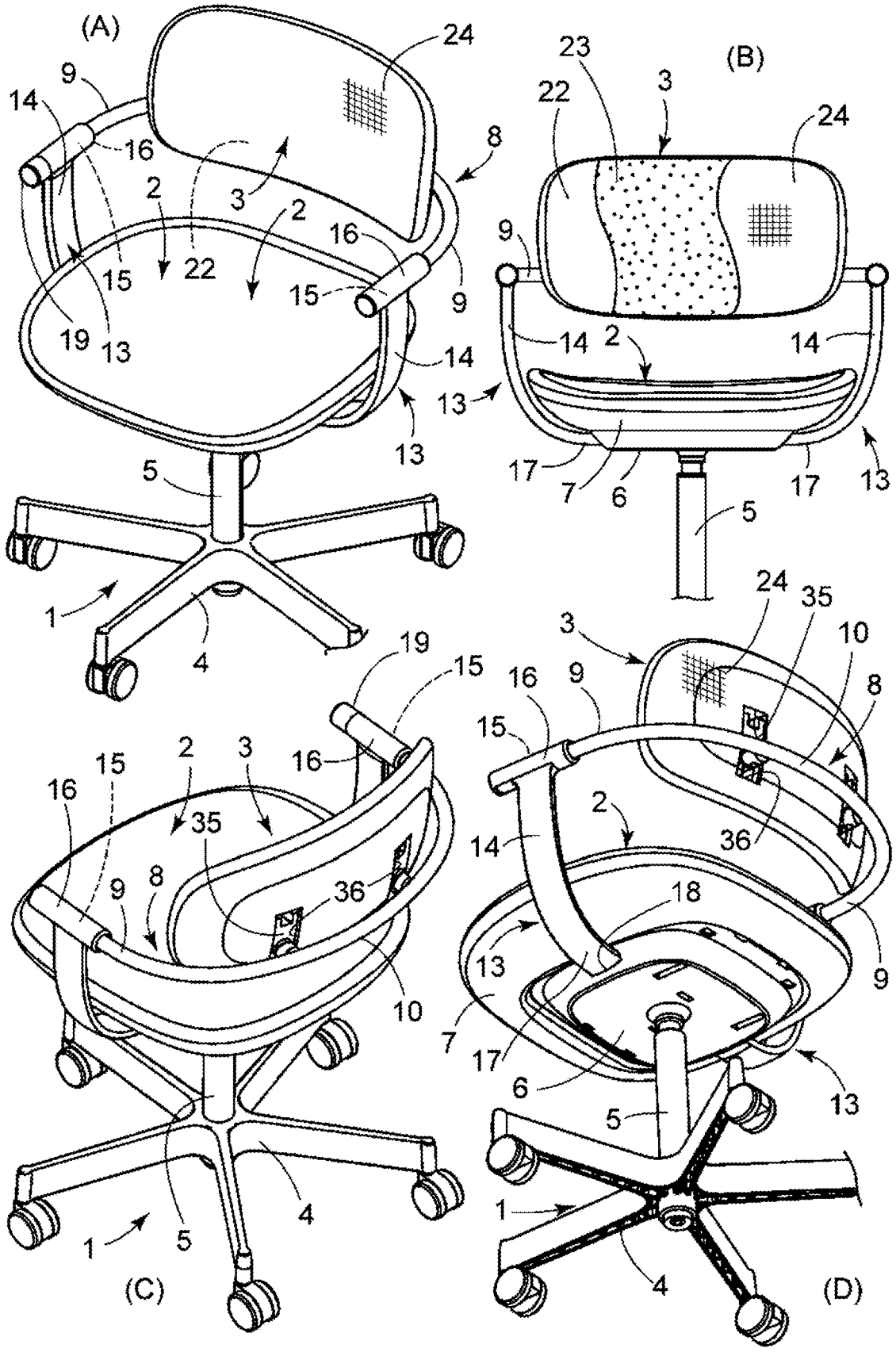
FIG. 1 is composed of views illustrating an appearance of a chair according to a first embodiment, where a section (A) is a perspective view seen from the front upper side, the section (B) is a partial front view, the section (C) is a perspective view seen from the upper rear, and the section (D) is a perspective view seen from the lower rear.

First, an outline of a chair will be described with reference to FIGS. 1 to 3. As illustrated in FIG. 1, the chair includes a leg device 1, a seat 2, and a backrest 3 as basic elements. The leg device 1 has a structure in which a pedestal 5 composed of a gas cylinder is erected at the center of a grounding body 4 having a plurality of (five) branch arms and casters are provided at the tips of the arms. Therefore, the embodiment is applied to a swivel chair.

As illustrated in the section (D) of FIG. 1, a base 6 having a substantially quadrangular shape in a bottom view (and a plan view) is fixed to an upper end of the pedestal 5. A seat receiving member 7 is mounted on the base 6 to be slidable back and forth and a seat 2 is attached to an upper surface of the seat receiving member 7. The base 6 is, for example, an aluminum die cast product and the seat receiving member 7 is, for example, a synthetic resin molded product.

Although details will be described later, the seat receiving member 7 is biased to a retracted position by a spring as an example of an elastic body, and when the body of the seated person becomes freely stretchable during rocking, the seat 2 and the seat receiving member 7 can be pushed forward by the buttocks. In FIGS. 3A and 3B, the state in which the seat 2 is advanced is illustrated. As can be understood from the comparison between the sections (A) and (B) of FIG. 3, in the embodiment, the seat receiving member 7 and the seat 2 move forward while slightly rising.

The chair includes an upper support frame 8 arranged to surround the seated person from behind at a position higher than the seat 2. Therefore, the upper support frame 8 includes left and right side portions 9 located on the left and right sides of the seated person (and the backrest 3) and a rear portion 10 located behind the seated person (and the backrest 3) in a front view. The backrest 3 is connected to the rear portion 10 to be tiltable backward.

Naturally, the backrest 3 is arranged in front of the rear portion 10. The upper support frame 8 is made of a metal pipe such as a steel pipe, but it may be made of a square steel pipe or a metal round bar or a square bar.

The backrest 3 of the embodiment is curved in a shape that is bulged backward (concaved forward) in a plan view to hold the body of a seated person from behind and the rear portion 10 of the upper support frame 8 is curved to follow the curvature of the backrest 3.

That is, in plan view, the rear portion 10 of the upper support frame 8 and the rear surface of the backrest 3 have similar shapes. The side portion 9 and the rear portion 10 are smoothly continuous to form a curved curve in a plan view. Therefore, the side portion 9 and the rear portion 10 are each curved in a plan view. After all, the upper support frame 8 is curved as a whole in a shape close to a circular arc, and as clearly illustrated in FIGS. 2A to 2C, there is a certain gap E between the upper support frame 8 and the backrest 3. The upper support frame 8 is in a horizontal posture as a whole.

The left and right side portions 9 of the upper support frame 8 are connected to side support bodies 13 arranged on the left and right sides of the seat 2 to be able to tilt. The side support body 13 is, for example, an aluminum die cast product. The side support body 13 includes a plate-shaped strut portion 14 which is vertically long and a substantially circular upper horizontal portion 15 which is integrally formed at the upper end thereof and which is long in a front-rear direction. The side portion 9 of the upper support frame 8 is connected to the rear portion of the upper horizontal portion 15 to tilt against the elasticity. The upper horizontal portion 15 is covered with a protective cover 16 of an elastomer type.

At the lower end of the strut portion 14 of the side support body 13, a base portion 17 which wraps around below the seat 2 is integrally formed. The tip of the base portion 17 is fitted into an engaging hole 18 (see the section (D) of FIG. 1 and the section (B) of FIG. 2) formed in the base 6 and the tip is fixed to the base 6 with a bolt.

As described above, the pedestal 5 is composed of a gas cylinder, and when the lock of the gas cylinder is released, the heights of the seat 2 and the backrest 3 can be freely adjusted. Then, as clearly illustrated in the sections (A) and (C) of FIG. 1, a knob 19 for unlocking the gas cylinder is provided on the upper horizontal portion 15 of the side support body 13 on the right side to be rotatable about the axis of the upper horizontal portion 15. The knob 19 can be rotated in either the left or right direction and the lock of the gas cylinder is released by rotating it in either direction.

The rotation of the knob 19 is transmitted to the lock release lever via the wire inserted through the tube. The wire is arranged in the groove formed in the strut portion 141 of the side support body 13 (details will be described below). It is also possible to attach an elbow rest 20 to the upper horizontal portion 15 of the side support body 13 as shown by the alternate long and short line in the sections (A) and (B) of FIG. 2.

(2) Rocking Movement

Figure 3:
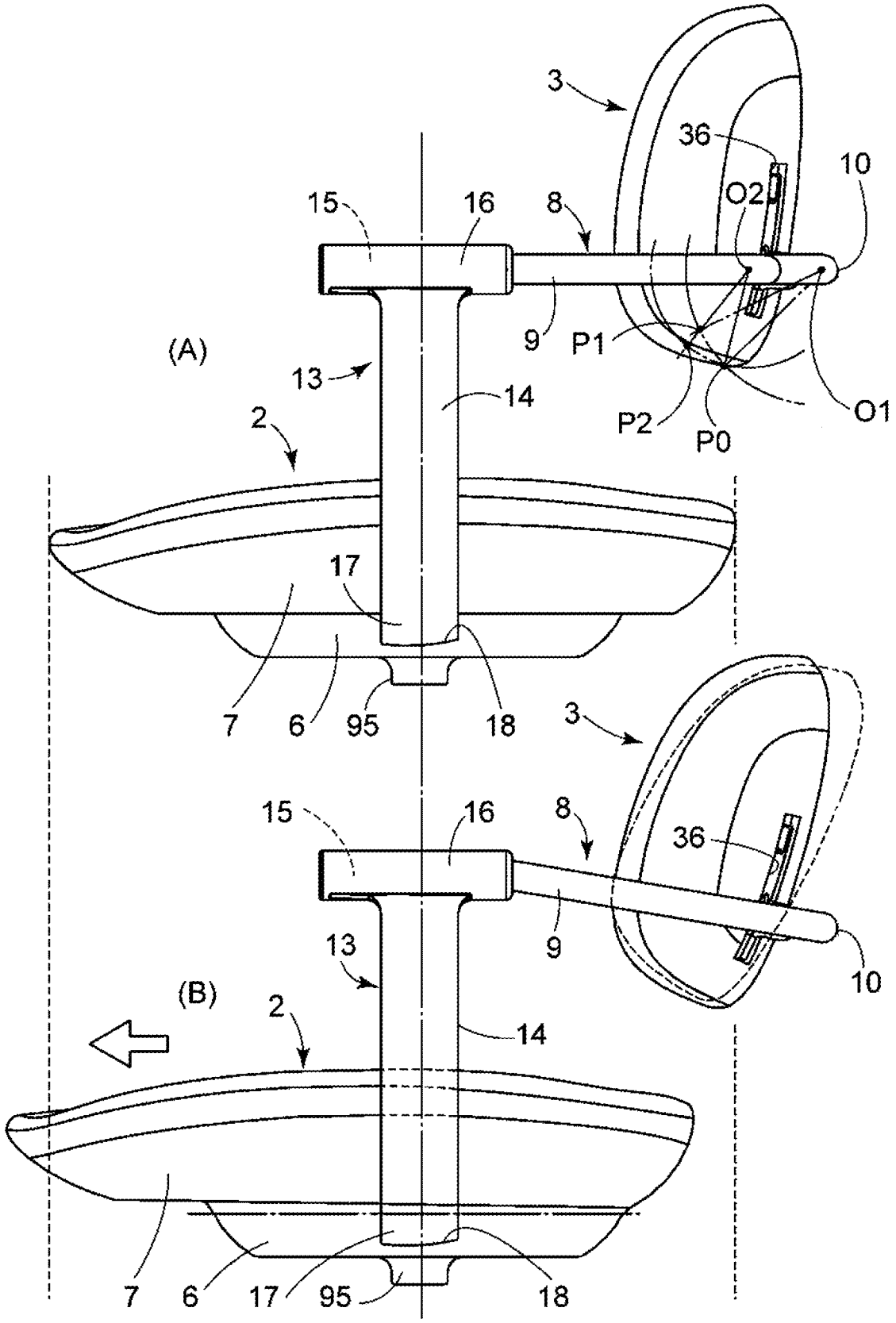
FIG. 3 is composed of a section (A) which is a side view in a state before rocking, and a section (B) which is a side view in a rocking state.

As illustrated in FIG. 3, in the embodiment, when the seated person leans against the backrest 3, first, the upper support frame 8 tilts with respect to the side support body 13 to perform a first-stage rocking. Next, when the upper body is bent backward, the backrest 3 tilts backward with respect to the upper support frame 8 and a second-stage rocking is performed. Therefore, even when the pivoting angle of the upper support frame 8 and the pivoting angle of the backrest 3 are not so large, the tilt angle can be increased as a whole. Therefore, it is possible to provide the seated person with a high level of comfort with a simple structure.

Since the pivoting fulcrum of the upper support frame 8 is located at a position higher than seat 2 and has a substantially horizontal posture in a side view, the backrest 3 hardly moves backward by tilting the upper support frame 8 backward. Therefore, there is no problem in that the body moves backward greatly due to rocking and the person behind is disturbed.

When the upper body leans backward, the body becomes extendable, but in the embodiment, since the seat advances, the extension of the body is allowed. Therefore, the seated person can enjoy a high level of comfort instead of rocking in a cramped state. In other words, by combining the rocking in two stages and the forward movement of the seat, it is possible to secure a high rocking function and high comfort without retracting the backrest 3, being one of the advantages of the embodiment.

For example, in office work, a user may see a monitor on a desk in a rocking state. Here, while preventing the upper body from bending, leaning on the backrest 3, and pulling the chin, the line of sight is directed to the monitor. In the embodiment, since the upper support frame 8 tilts by leaning on the backrest 3 without bending the upper body, the user can see the monitor while ensuring a stable rocking posture.

On the other hand, when the upper body is bent, the backrest 3 tilts backward with respect to the upper support frame 8. Therefore, a user can enjoy a comfortable rocking state by the stretch effect. When the user performs desk work, there are cases where the upper body tends to lean forward and cases where the upper body stands upright. In the embodiment, since the pivoting fulcrum of the upper support frame 8 is located at a height around the waist position of the seated person, the upper support frame 8 does not tilt even when the user takes a forward leaning posture or an upright posture with the waist resting against the backrest 3. Therefore, the user can work in the forward leaning posture or the upright posture while maintaining the state in which the waist portion rests against the backrest 3.

As illustrated in the sections (B) and (C) of FIG. 2, the mounting position of the backrest 3 with respect to the upper support frame 8 is located below the up-down intermediate height position of the backrest 3. Therefore, when the backrest 3 tilts backward with respect to the upper support frame 8, a large moment is applied to the backrest 3 and the backrest 3 easily tilts backward. It is possible to prevent the phenomenon that the lower end of the backrest 3 strongly hits the body of the seated person.

As illustrated in the section (A) of FIG. 3, when the backrest 3 rotates about a rear end axis center O1 of the rear portion 10 in the upper support frame 8, an arbitrary point PO at the lower end of the backrest 3 moves to P1. Since P1 is considerably higher than PO, the backrest 3 tends to rotate while pushing up the seated person, it can be said that this becomes a factor that prevents the light rearward tilt of the backrest 3 and that the shirt rolling phenomenon is likely to occur due to the backrest 3 rising relatively to the body of the seated person.

Figure 2:
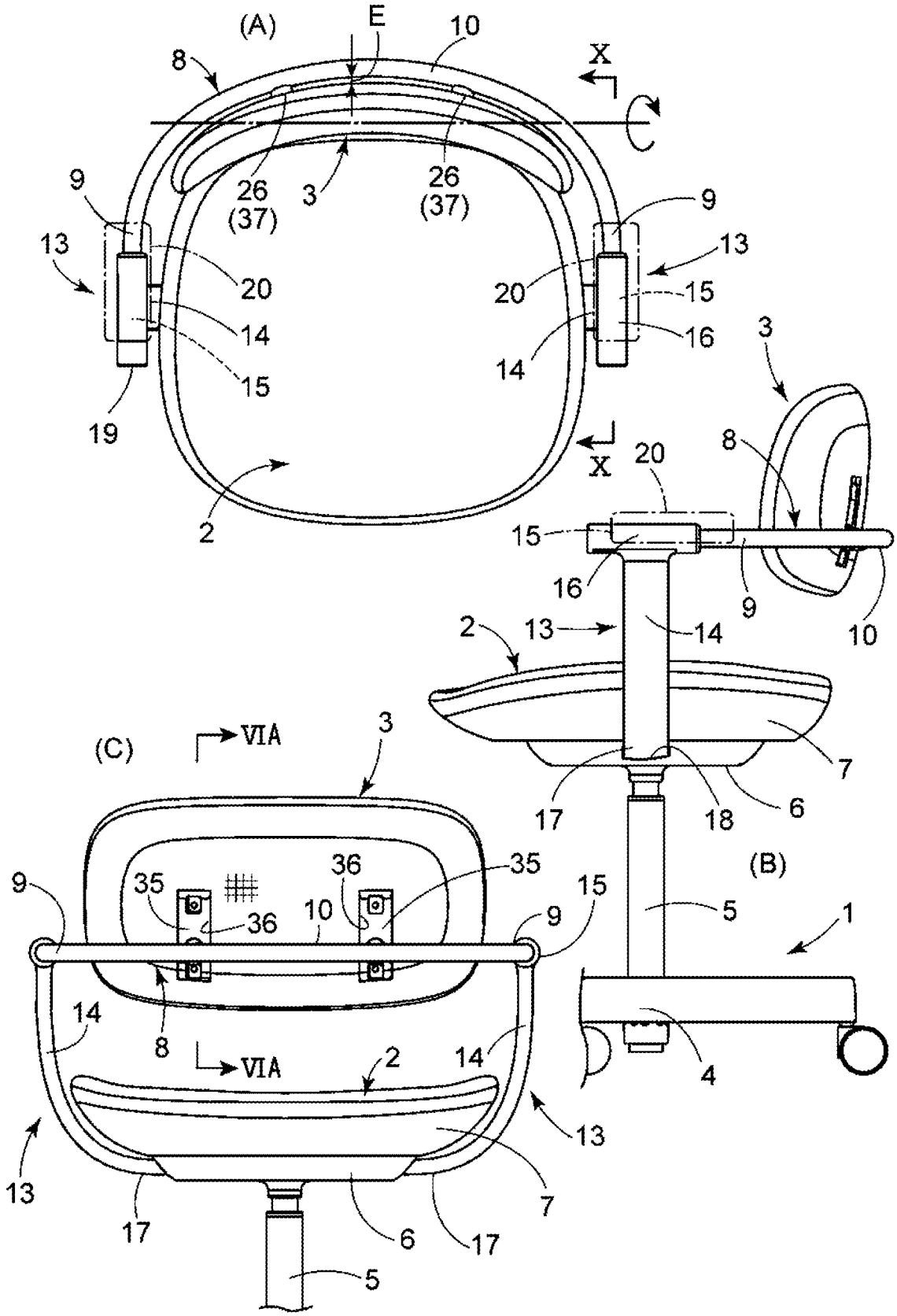
FIG. 2 is composed of a section (A) which is a plan view, a section (B) which is a side view, and (C) which is a rear view.

On the other hand, in the embodiment, as illustrated in the sections (A) of FIG. 2 and the section (A) of the FIG. 3, the pivoting axis center 02 of the backrest 3 is displaced forward from the rear surface of the backrest 3, even when the backrest 3 tilts backward and PO moves to P2, the height positions of PO and P2 hardly change. Therefore, the backrest 3 can pivot lightly without resistance and the shirt rolling phenomenon does not occur.

(3) Backrest and Mounting Structure Thereof

Next, the structure of the backrest 3 and the connecting structure of the backrest 3 with respect to the upper support frame 8 will be described. First, the structure illustrated in FIGS. 4 to 6 will be described.

Figure 4:
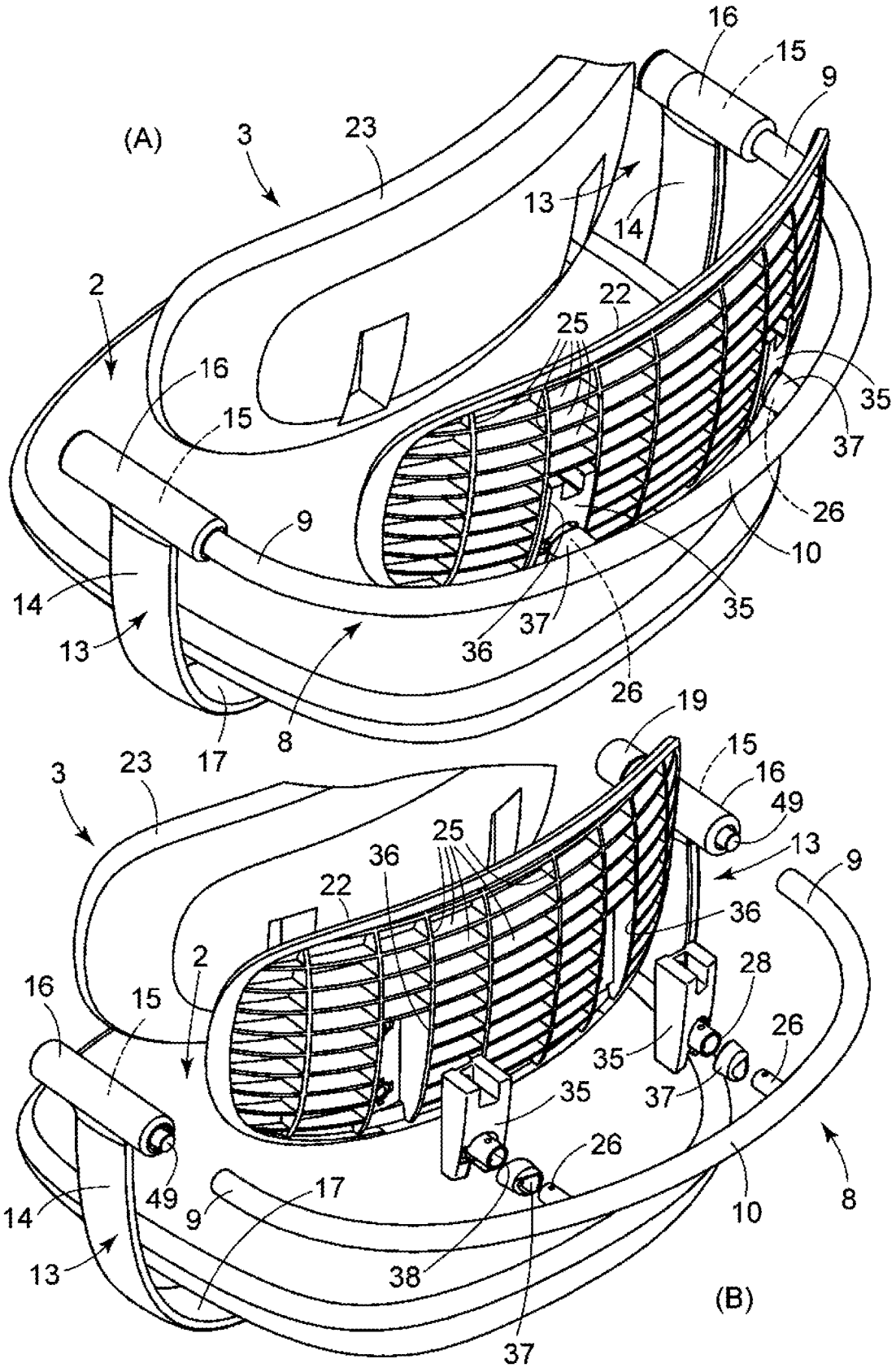
FIG. 4 is composed of a section (A) and (B) which are exploded perspective views.

As illustrated in FIG. 4 (see also the section (B) of FIG. 1), the backrest 3 includes a back inner shell (back plate) 22 and a back cushion material 23 stretched on the front surface thereof and the back cushion material 23 is covered with a skin material 24. As can be understood from the sections (C) and (D) of FIG. 1 and FIG. 6, the skin material 24 is in the shape of a bag and also covers the rear surface of the back inner shell 22. Therefore, most of the appearance of the backrest 3 is composed of the skin material 24. The back cushion material 23 may be fixed to the back inner shell 22 by insert molding. The back cushion material 23 may be wrapped around to the back surface of the back inner shell 22 by either the insert molding method or the retrofitting method.

Figure 6:
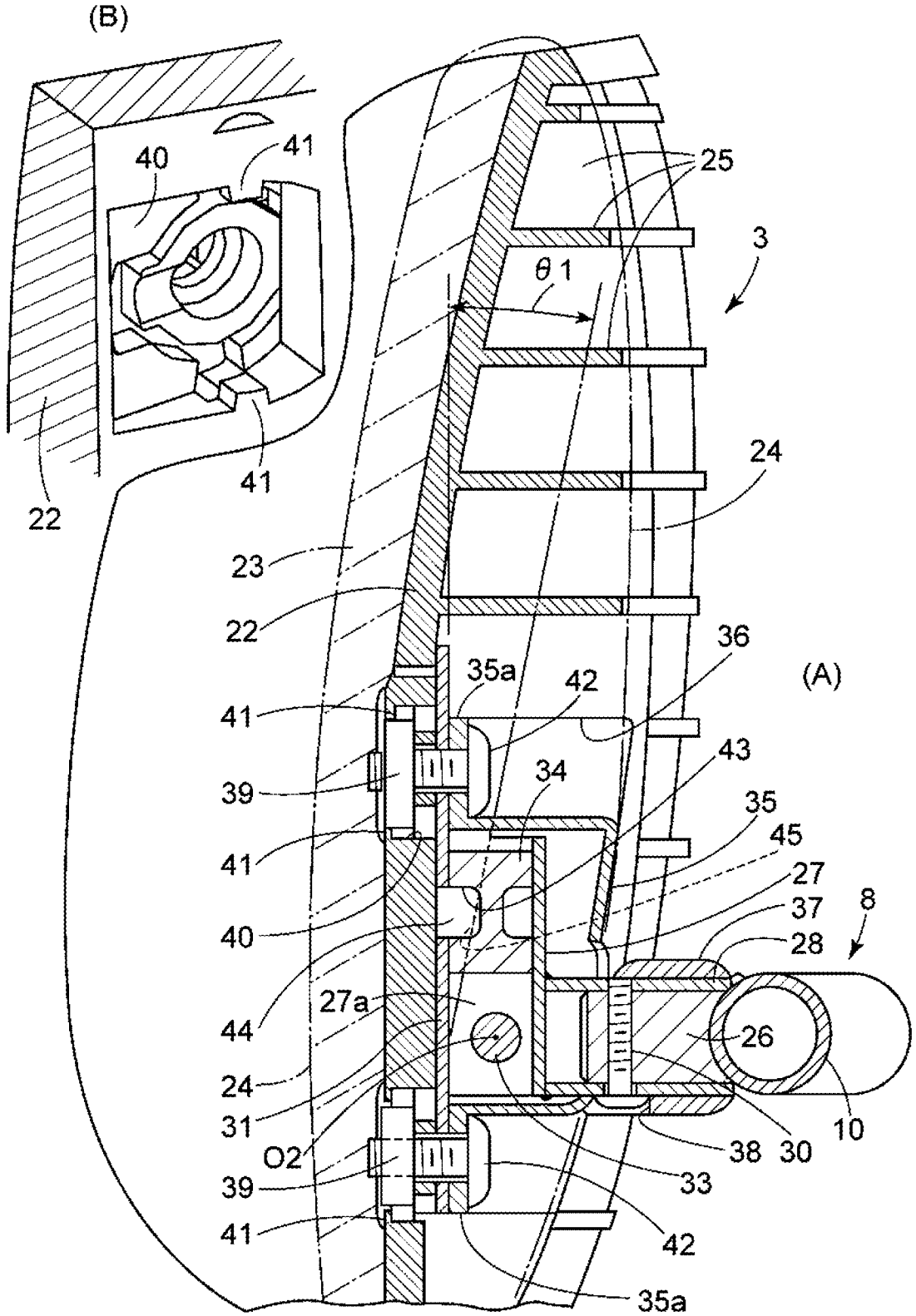
FIG. 6 is composed of a section (A) which is a cross-sectional view taken along the line VIA-VIA in the section (C) of FIG. 2, and a section (B) which is a perspective view of a nut holding portion of a back inner shell as seen from the front side.

The back inner shell 22 is a molded product made of synthetic resin and has a shape that is recessed forward in plan view as described above. As illustrated in FIG. 4, a large number of reinforcing ribs 25 extending vertically and horizontally are formed on the rear surface of the back inner shell 22. As illustrated in FIG. 6, the backrest 3 is gently curved to bulge toward the front in a longitudinal cross-sectional side view. Therefore, the backrest 3 fits the S-shaped curve of the back of the seated person and allows the seated person to easily bend the upper body backward. A protrusion phenomenon due to the lower end hardly occurs during rocking.

Figure 5:
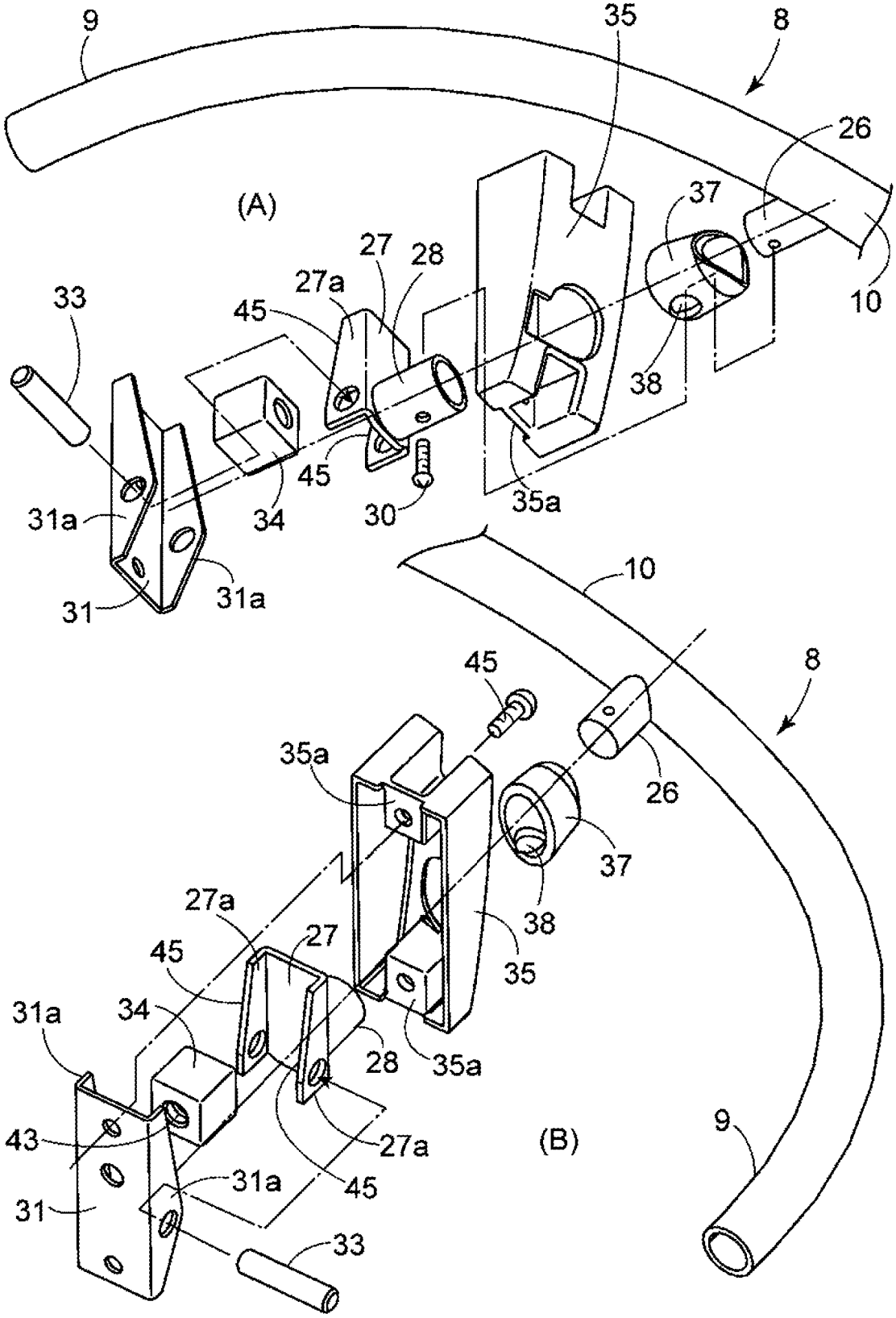
FIG. 5 is composed of a section (A) and (B) which are exploded perspective views illustrating a connecting structure of a backrest.

For example, as illustrated in the section (B) of FIG. 4, in the rear portion 10 which forms the upper support frame 8, the two left and right boss bodies 26 protrude forward, and as illustrated in FIG. 5, a receiving bracket 27 is fixed to the boss body 26. The receiving bracket 27 includes a pipe 28 fitted to the boss body 26 from the outside and left and right forward-directed side plates 27*a* and the pipe 28 is fixed to the boss body 26 by a screw 30. The boss body 26 is welded to the rear portion 10 of the upper support frame 8.

As illustrated in FIG. 5, in the front of the receiving bracket 27, a vertically long pushing bracket 31 having left and right rearward-directed side plates 31*a* is arranged. The receiving bracket 27 is disposed between the left and right side plates 31*a* of the pushing bracket 31 and both side plates 27*a* and 31*a* are connected by a transversely long support shaft 33. A first elastic body 34 made of foamed urethane elastomer (rubber) is arranged between the pushing bracket 31 and the receiving bracket 27 and on the upper side of the support shaft 33.

The receiving bracket 27 and the pushing bracket 31 are covered from behind by a vertically long cover 35 made of synthetic resin, and the receiving bracket 27, the pushing bracket 31 and the cover 35 form a connecting unit. Then, as illustrated in FIG. 4, on the rear surface of the back inner shell 22, by partially eliminating the reinforcing ribs 25, a vertically long rectangular recess portion 36 is formed. The connecting unit including the receiving bracket 27, the pushing bracket 31 and the cover 35 is fitted into the rectangular recess 36 from the rear.

The pipe 28 of the receiving bracket 27 is covered with a tubular protective cap 37 made of a rubber material such as elastomer. As clearly illustrated in FIGS. 5A to 6B, an escape hole 38 is formed in a lower portion of the protective cap 37 so that the screw 30 can be inserted therethrough.

As illustrated in FIG. 6, nut holding holes 40 into which nuts 39 can be fitted from the front side are formed in a part of a front surface of the back cushion material 23, which is the part corresponding to the upper and lower portions of the left and right rectangular recess portions 36. The nut 39 is formed in a square shape and the nut holding hole 40 is formed with an engagement protrusion 41 for holding the nut 39 to not come off. The nut 39 is forcibly fitted into the nut holding hole 40 with the engagement protrusion 41 deformed.

As illustrated in FIG. 5, in the cover 35, a pair of upper and lower overlapping portions 35*a* overlapping the upper and lower portions of the pushing bracket 31 are formed and a screw 42 inserted into the overlapping portion 35*a* of the cover 35 and the pushing bracket 31 is screwed into the nut 39. Therefore, the cover 35 and the pushing bracket 31 are fastened together with the back inner shell 22 at two places, upper and lower.

As illustrated in the section (B) of FIG. 5, the pushing bracket 31 and the first elastic body 34 are formed with concentric positioning holes 43 communicating with each other, and as illustrated in the section (A) of FIG. 6, the back inner shell 22 is formed with a positioning protrusion 44 which fits into the positioning hole 43. As a result, the position of the pushing bracket 31 is accurately defined and the first elastic body 34 is held without falling.

In the sections (C) and (D) of FIG. 1 and the the sections (B) and (C) of FIG. 2, the cover 35 is exposed, but in reality, the cover 35 is covered with the skin material 24 and cannot be visually recognized. Only protective cap 37 is exposed from the skin material 24.

Figure 7:
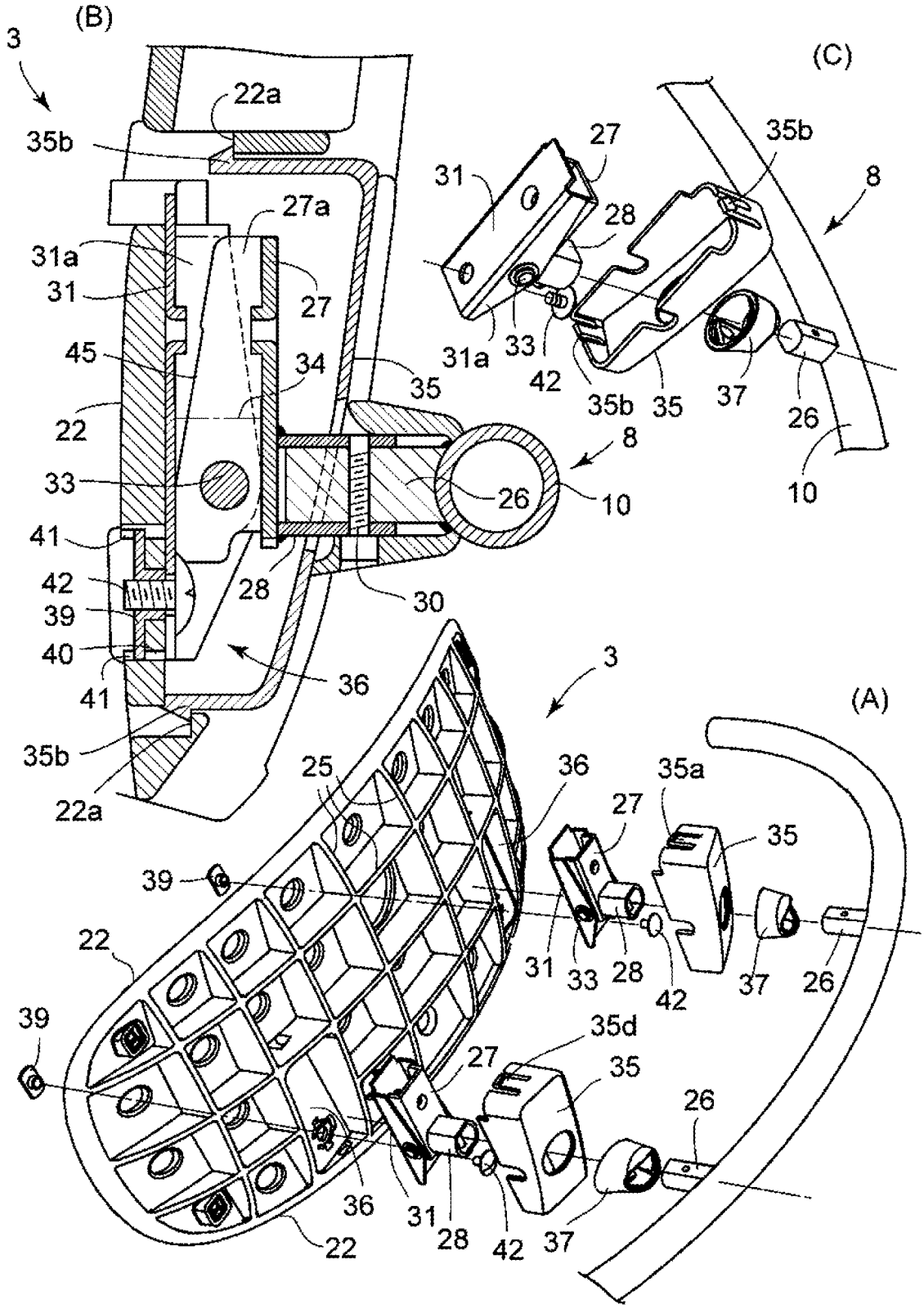
FIG. 7 is composed of views illustrating a modification example of the support structure of the backrest, where a section (A) is an exploded perspective view seen from the rear, a section (B) is a cross-sectional view of the same portion as the section (A) of FIG. 6, and a section (C) is an exploded perspective view seen from the front of a part of the member.

FIG. 7 illustrates a modification example. In the modification example, first, the boss body 26 and the pipe 28 are non-circular with flat surfaces on the top and bottom. When flat surfaces are formed on the top and bottom in this way, drilling can be performed accurately. In the modification example of FIG. 7, the pushing bracket 31 is fixed to the back inner shell 22 with a screw 42 only at a lower portion thereof. As the attachment means of the cover 35, snap engagement using engagement claws 35*a* provided at the top and bottom is adopted. Therefore, the back inner shell 22 is formed with an engagement hole 22*a* into which the engaging claw 35*a* is elastically deformed and then engaged. The nut 39 is T-shaped.

(4) Summary of Backrest

As illustrated in FIG. 5, the side plate 27*a* of the receiving bracket 27 is formed with an inclined portion 45 which shifts backward while going upward. Therefore, there is a space between the side plate 27*a* of the receiving bracket 27 and the pushing bracket 31 which spreads upward by a predetermined angle θ1. Therefore, when the seated person leans backrest 3 and bends the upper body backward, the backrest 3 can be tilted (rotated) backward by θ1 with the axis center (rotation axis center O2) of the support shaft 33 as a fulcrum against the elasticity of the first elastic body 34.

The first elastic body 34 is pre-compressed so that elastic restoring force is generated when the load of the seated person is not applied. Therefore, the phenomenon that the backrest 3 suddenly tilts backward without resistance due to the load of the seated person does not occur and an appropriate resistance against backward tilting is imparted. The forward rotation of the backrest 3 is regulated by contacting a part of the side plate 27*a* of the receiving bracket 27, which is the part below the inclined portion 45, with the pushing bracket 31.

As described above, the backrest 3 of the embodiment has a shape that is recessed forward in plan view and has excellent fitability to a user. Further, the upper support frame 8 has a similar shape to the back surface of the backrest 3, so it is well-designed and has an excellent appearance. The upper support frame 8 is excellent in rigidity because the side portion 9 and the rear portion 10 are integrally continuous. Therefore, the upper support frame 8 can secure the necessary strength without making it excessively thick.

In JP-A-2011-136203, the rear portion of the upper support frame has a linear posture and is fixed to the rear surface of the backrest by left and right holder members (a known technique regarding the backrest).

When connecting the backrest to one rear portion in a straight horizontal position so that it can be tilted backward, the backrest can be connected at multiple left and right positions. When the upper support frame 8 is curved in a plan view as in the embodiment, in order to allow backward tilting of the backrest 3, the backrest 3 must be connected to the rear portion 10 at the left-right intermediate portion, which causes a problem that the connection strength becomes weak. In the embodiment, one of the problems is to solve such a problem (a first problem regarding the backrest).

In the embodiment, by providing a gap between the backrest 3 and the rear portion 10, the backrest 3 can be connected to be tiltable rearward via the plurality of boss bodies 26 which are arranged apart from each other on the left and right. Therefore, the support strength of the backrest 3 can be improved (a first effect regarding the backrest).

As explained with reference to FIG. 3, when the center of rotation of the backrest 3 is located behind the rear surface of the backrest 3, there is a problem that the smoothness of the backward tilting of the backrest 3 is deteriorated and a shirt rolling phenomenon is likely to occur. The embodiment also needs to solve the problem (a second problem regarding the backrest).

In the embodiment, the support shaft 33 is arranged inside the rectangular recess portion 36 and a rotation fulcrum O2 of the backrest 3 is arranged in front of the rear surface of the backrest 3. As a result, as already described with reference to FIGS. 3A and 3B, the backward tilting of the backrest 3 can be performed lightly and the shirt rolling can also be prevented (a second effect regarding the backrest).

A spring such as a coil spring can be used as an elastic body which gives resistance to backward tilting of the backrest 3. When a urethane foam elastomer is used as the first elastic body 34 as in the embodiment, there is an advantage that it can be easily arranged even in a narrow space.

In the embodiment, since the receiving bracket 27, the pushing bracket 31, the cover 35, and the protective cap 37 are unitized, it is possible to easily assemble the chair by attaching the unit to the backrest 3 in advance, covering it with the skin material 24, then fitting the pipe 28 of the receiving bracket 27 into the boss body 26 and fixing the pipe 28 with the screw 30.

(5) Mounting Structure for Upper Support Frame

Next, the connecting structure of the upper support frame 8 to the side support body 13 will be described. First, the configurations of FIGS. 8 to 10 will be described.

As described above, the right side support body 13 is provided with an operation member for unlocking the pedestal 5 (gas cylinder). Therefore, the left and right side support bodies 13 have a slightly different structure, but the upper support frames 8 have the same connection structure on the left and right sides.

Figure 9:
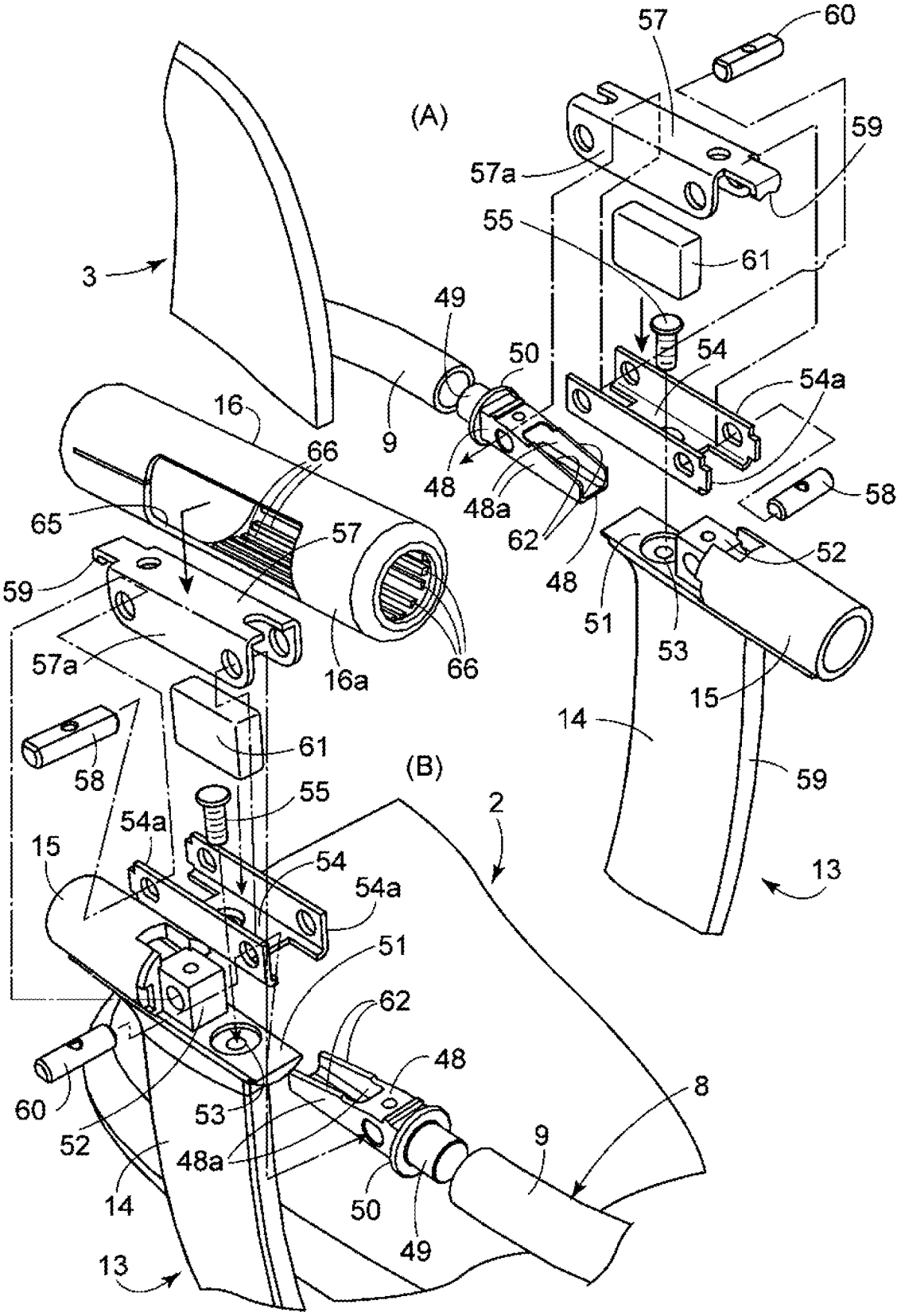
FIG. 9 is composed of views illustrating the connecting structure of the upper support frame, where a section (A) is an exploded perspective view seen from the front upper side, and a sectopm (B) is a separated perspective view seen from the upper back side.

As clearly illustrated in FIG. 9, a pushing bracket 48 including left and right upward-directed side plates 48*a* is fixed to the side portion 9 of the upper support frame 8 by welding. The pushing bracket 48 includes a channel-shaped portion including the upward-directed side plates 48*a* and a boss portion 49 located behind the channel-shaped portion, and the boss portion 49 is fixed to the side portion 9 of the upper support frame 8 by welding. A flange corresponding to the front end surface of the upper support frame 8 is integrally formed at the attachment base of the boss portion 49. The pushing bracket 48 is made of steel casting.

As illustrated in FIG. 9, a flat portion 51 is formed in a portion of the side support body 13 which is closer to the rear of the upper horizontal portion 15. On the flat portion 51, a rectangular block 52 and a tap hole 53 located behind it are formed. A channel-shaped lower receiving bracket 54 including an upward-directed side plate 54*a* is superposed on the flat portion 51 and the lower receiving bracket 54 is fixed to the flat portion 51 by a screw 55 screwed into the tap hole 53. A notch for avoiding interference with the rectangular block 52 is formed in the front portion of the lower receiving bracket 54 and the side plates 54*a* of the lower receiving bracket 54 are located on the left and right sides of the rectangular block 52.

Inside the lower receiving bracket 54, an upper receiving bracket 57 including a downward-directed side plate 57*a* is fitted. The upper receiving bracket 57 holds the rectangular block 52 from above and the front portions of the side plates 57*a* and 54*a* of the upper and lower receiving brackets 57 and 54 and the rectangular block 52 are connected by a front support shaft 58 extending in the left-right direction. A downward-directed hook portion 59 is formed by bending at the front end of the upper receiving bracket 57.

A groove portion of the pushing bracket 48 enters the inside of the upper receiving bracket 57 and the rear portions of the side plates 57*a* and 54*a* of the upper and lower receiving brackets 57 and 54 and the rear portion of the side plate 48*a* of the pushing bracket 48 are connected by a rear support shaft 60 extending in the left-right direction. A second elastic body 61 made of urethane foam elastomer is interposed between the pushing bracket 48 and the upper receiving bracket 57.

The upper and lower receiving brackets 57 and 54 are fixed so that they cannot rotate. The pushing bracket 48 is connected by one rear support shaft 60 and the left and right side plates 48*a* of the pushing bracket 48 are formed with inclined portions 62 which are lowered toward the front. Therefore, the upper support frame 8 can tilt about the axis center of the rear support shaft 60 by a divergence angle θ2 of the inclined portion 62 and the upper receiving bracket 57 against the elasticity of the second elastic body 61. The second elastic body 61 is also precompressed.

Figure 10:
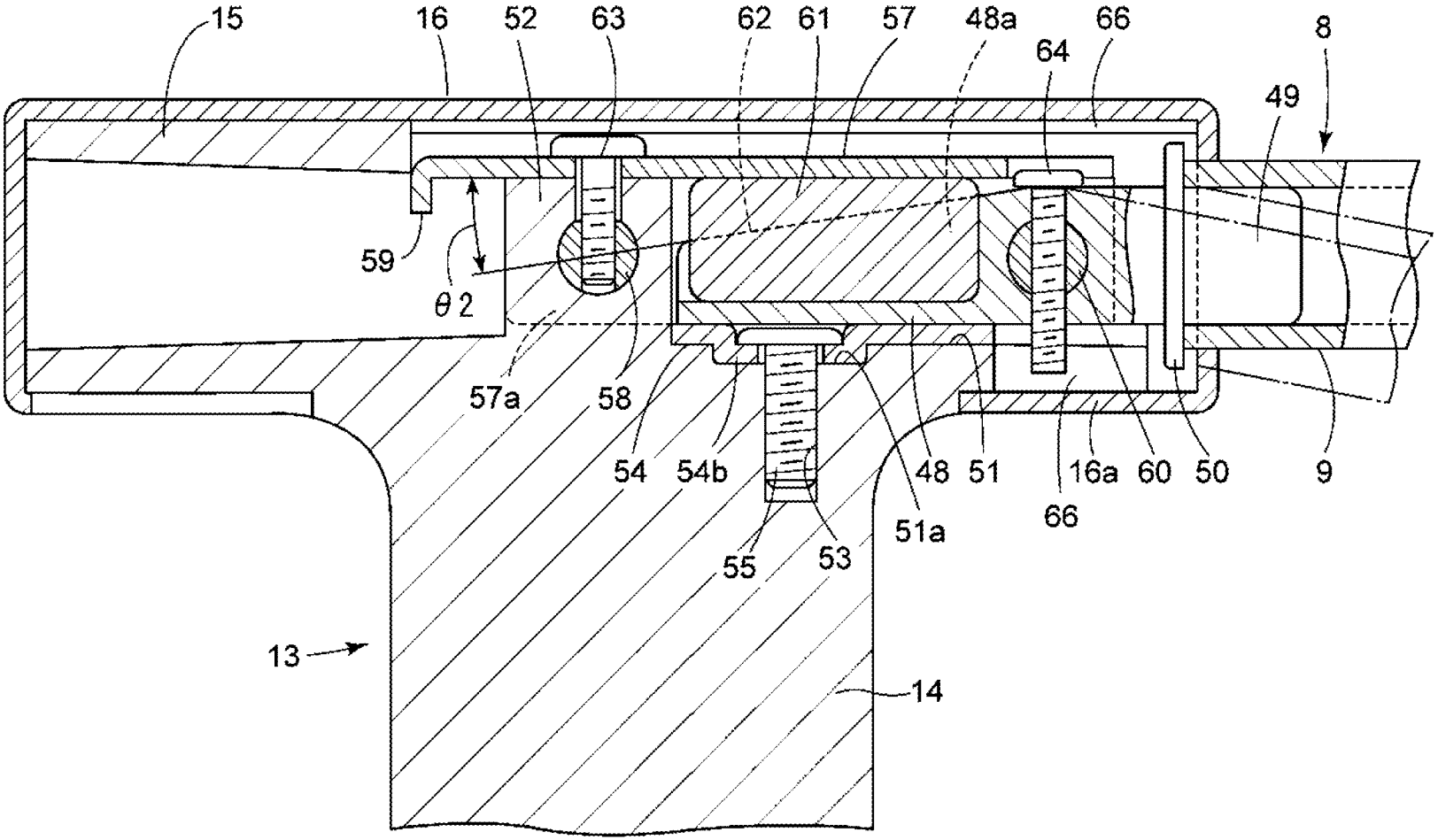
FIG. 10 is a cross-sectional view taken along the line X-X of FIG. 2A.

As illustrated in FIG. 10, the upper receiving bracket 57, the rectangular block 52, and the front support shaft 58 are fixed by a front screw 63 screwed into the front support shaft 58 from above. The pushing bracket 48 and the rear support shaft 60 are fixed by a rear screw 64 screwed into the rear support shaft 60 from above.

As clearly illustrated in FIG. 10, the lower receiving bracket 54 is formed with a downward-directed protruding portion 54*b* into which the head of the front screw 55 is inserted and which is bulged downward. Correspondingly, the flat portion 51 of the upper horizontal portion 15 is formed with a recess portion 51*a* into which the downward-directed protruding portion 54*b* is inserted.

The upper horizontal portion 15 of the side support body 13 is covered with the protective cover 16 described above. As clearly illustrated in the section (B) of FIG. 9, the rear portion of the protective cover 16 is a complete cylindrical portion 16*a* and a downward-directed opening portion 65 is formed behind it. Inside the protective cover 16, a large number of ribs 66 (see the section (B) of FIG. 9) having longitudinal lengths are formed.

Figure 8:
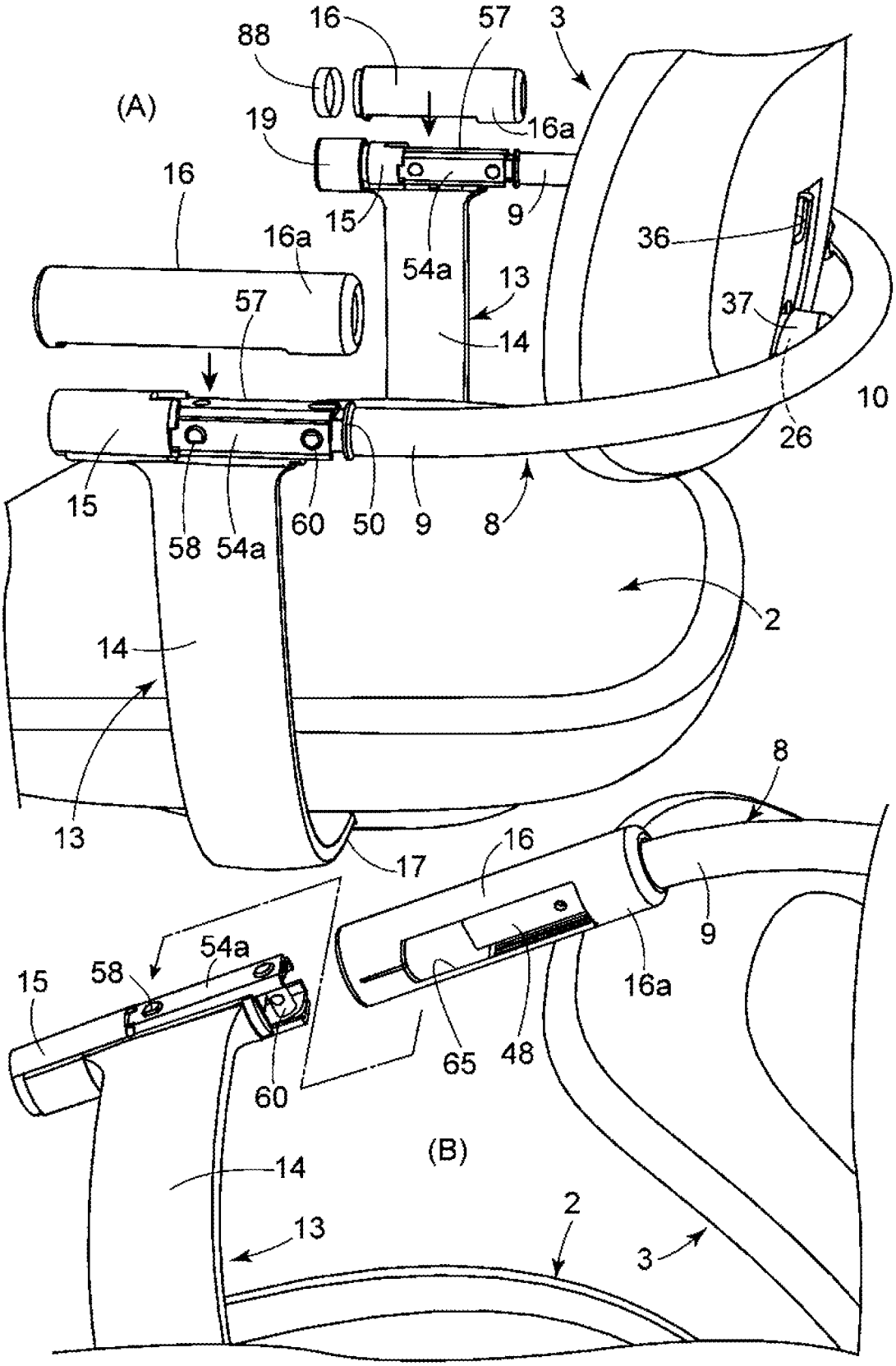
FIG. 8 is composed of views illustrating a connecting structure of an upper support frame, where a section (A) is a perspective view with a cover separated, and a section (B) is a perspective view with the upper support frame separated.

Then, as illustrated in the section (B) of FIG. 8, the protective cover 16 is attached to the upper support frame 8 in advance. When assembling the chair, the protective cover 16 is retracted rearward from the predetermined position, elastically deformed and bent upward to assemble each member, and then while moving the protective cover 16 toward the front side, the protective cover 16 is returned to its original shape, in such a manner that the protective cover 16 wraps the upper horizontal portion 15 and each member.

(6) Modification Example of Mounting Structure of Upper Support Frame

Figure 11:
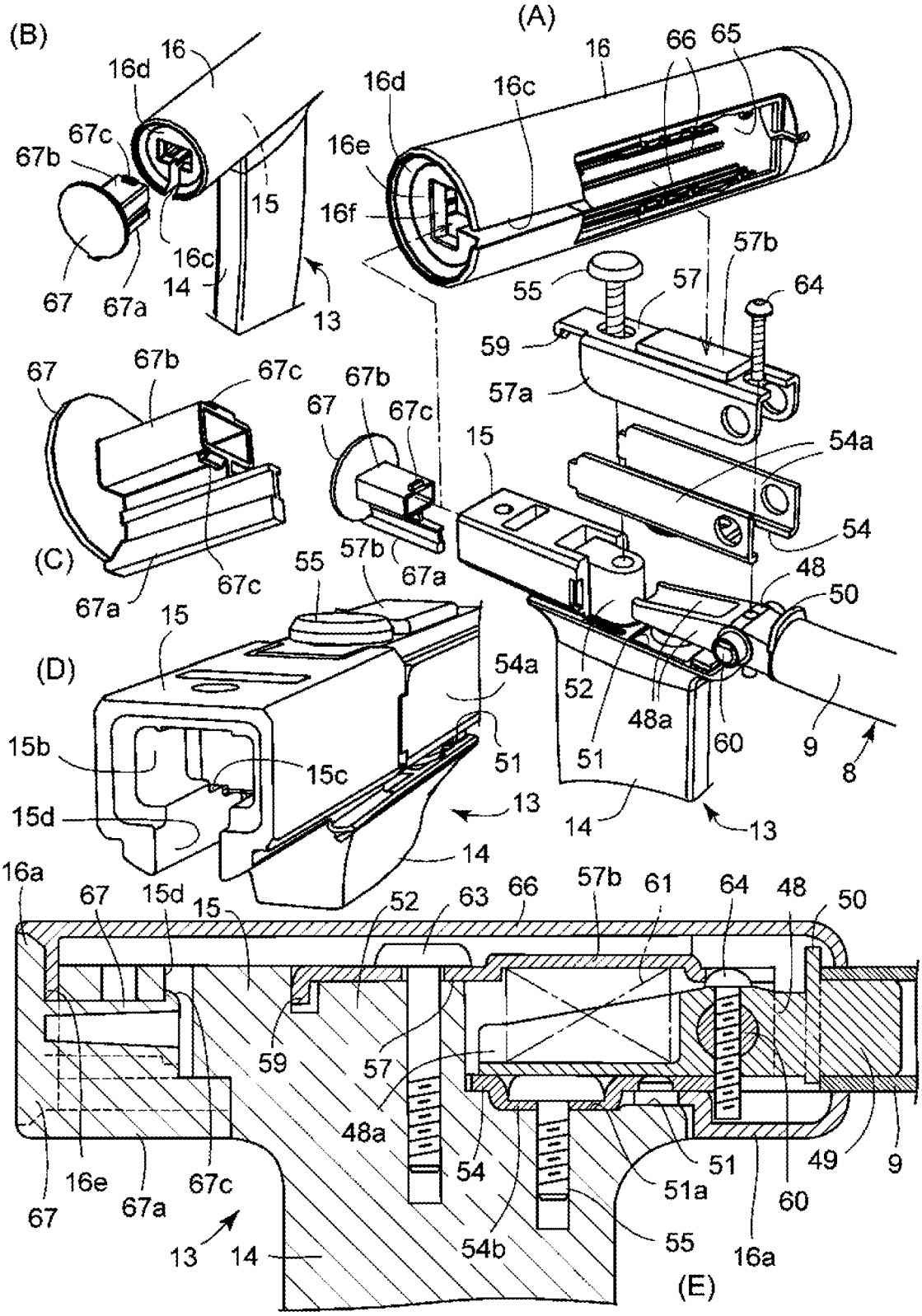
FIG. 11 is composed of views illustrating a modification example of the connecting structure of the upper support frame, where a section (A) is an exploded perspective view, a section (B) is an exploded perspective view of some members, a section (C) is a perspective view of a front cap, a section (D) is a perspective view of the upper support frame, and a section (E) is a cross-sectional view of the same portion as FIG. 10.

FIG. 11 illustrates a modification example of the form of the upper horizontal portion 15 and the connection structure of the upper support frame 8. In the modification example, first, the upper horizontal portion 15 has a rectangular shape and the rectangular block 52 has a U shape in a plan view. Although the embodiment also includes the upper and lower receiving brackets 57 and 54, the front support shaft 58 of FIG. 9 is not provided. The upper receiving bracket 57 is formed with an upward-directed bulging portion 57*b* which holds the second elastic body 61 to not be displaced.

In the modification example, the protective cover 16 is opened forward and the part in front of the opening portion 65 is divided by a front slit 16*c* opened downward. The front surface of the protective cover 16 is covered with a resin front cap 67. The front cap 67 is integrally formed with a lower rib 67*a* protruding rearward and an upper rib 67*b* having a lateral width larger than that of the lower rib 67*a*.

In the front part of the protective cover 16, a wall 16*e* overlapping the front surface of the upper horizontal portion 15 is formed. The wall 16*e* of the protective cover 16 and the upper horizontal portion 15 of the side support body 13 are formed with recess portions 16*f* and 15*b* into which the upper ribs 67*b* of the front cap 67 are fitted. An engagement claw 67*c* is formed at the rear end of the upper rib 67*b* of the front cap 67 and the engagement claw 67*c* engages with an engagement portion 15*c* formed inside the upper horizontal portion 15. As a result, the front cap 67 is held to not come off.

The upper half of the lower rib 67*a* of the front cap 67 is fitted into the front slit 16*c* of the protective cover 16. The lower half of the lower rib 67*a* of the front cap 67 is an umbrella portion that expands left and right and the portions of the protective cover 16 on both sides of the front slit 16*c* are covered with the umbrella portion of the lower rib 67*a* from below. Therefore, even when a person's fingertip hits the front portion of the protective cover 16 from below, the protective cover 16 will not be turned up.

The protective cover 16 is manufactured by injection molding. By having the front slit 16*c* in the form of a front opening, it can be manufactured in a state where it can be easily die-cut. Since both sides pinching the front slit 16*c* are covered with the lower rib 67*a* of the front cap 67, it is possible to prevent turning-up due to hitting of a person's fingertip. The protective cover 16 is molded by using a mold and then elastically deformed to be die-cut. The presence of the front slit 16*c* allows the protective cover 16 to be deformed to be easily die-cut.

(7) Summary of Mounting Structure for Upper Support Frame

When the chair has the elbow rest function, it is user-friendly. When the chair includes an elbow rest, a user may sit on the chair or stand up, and then the user sometimes stands up or sits down with hands gripping (grabbing) the elbow rest. Even when the elbow rest is set aside, it is convenient to include a member which supports the weight when sitting on the chair or standing up. However, when a dedicated armrest device is provided, the structure becomes complicated and the cost increases, and the design simplicity is impaired.

On the other hand, Design Registration No. 1627516 discloses that an arm protruding forward from the backrest is connected to a vertically long side support body to be tiltable backward. Since the side support body is merely a pillar structure, it cannot be expected to have an elbow rest function and it is not possible for a person to grasp the state part of the side support body by hand when sitting on or standing up in the chair.

In the embodiment, the improvement of such a current situation is one of the subjects and the chair is improved.

In the embodiment, one feature is that the side support body 13 is provided with the upper horizontal portions 15 which is long in the front-rear direction and the upper horizontal portion 15 can be grasped to sit on or stand up in a chair. That is, the upper horizontal portion 15 can be made to function as a grip portion (stretching portion) when seating or leaving the seat. Alternatively, the upper horizontal portion 15 can be made to function as an elbow rest. Either way, it's user-friendly. (Structure/Effect).

The upper horizontal portion 15 of the side support body 13 has a connecting function of the upper support frame 8 as a basic function. The upper horizontal portion 15 for connecting the upper support frame 8 so that it can be tilted can be used as a grip portion or an elbow rest, so that the structure does not become complicated. Therefore, the cost can be reduced and the simplicity is maintained and the aesthetic appearance is excellent. (Effect).

Since the upper horizontal portion 15 is long in the front-rear direction, it is possible to secure a disposition space of the members when connecting the upper support frame 8 to be tiltable. Therefore, the upper support frame 8 can be connected to the upper horizontal portion 15 with necessary strength. Providing the protective cover 16 as in the embodiment is particularly preferable because there is no restriction on the arrangement of the upper receiving bracket 57 and the like. The protective cover 16 has a unique meaning, and will be described later.

(8) Layout of Pedestal Lock Release Cable

Next, the lock release operation portion of the pedestal 5 and the configuration related thereto will be described. The drawings primarily refer to FIGS. 12 to 15.

Figure 12:
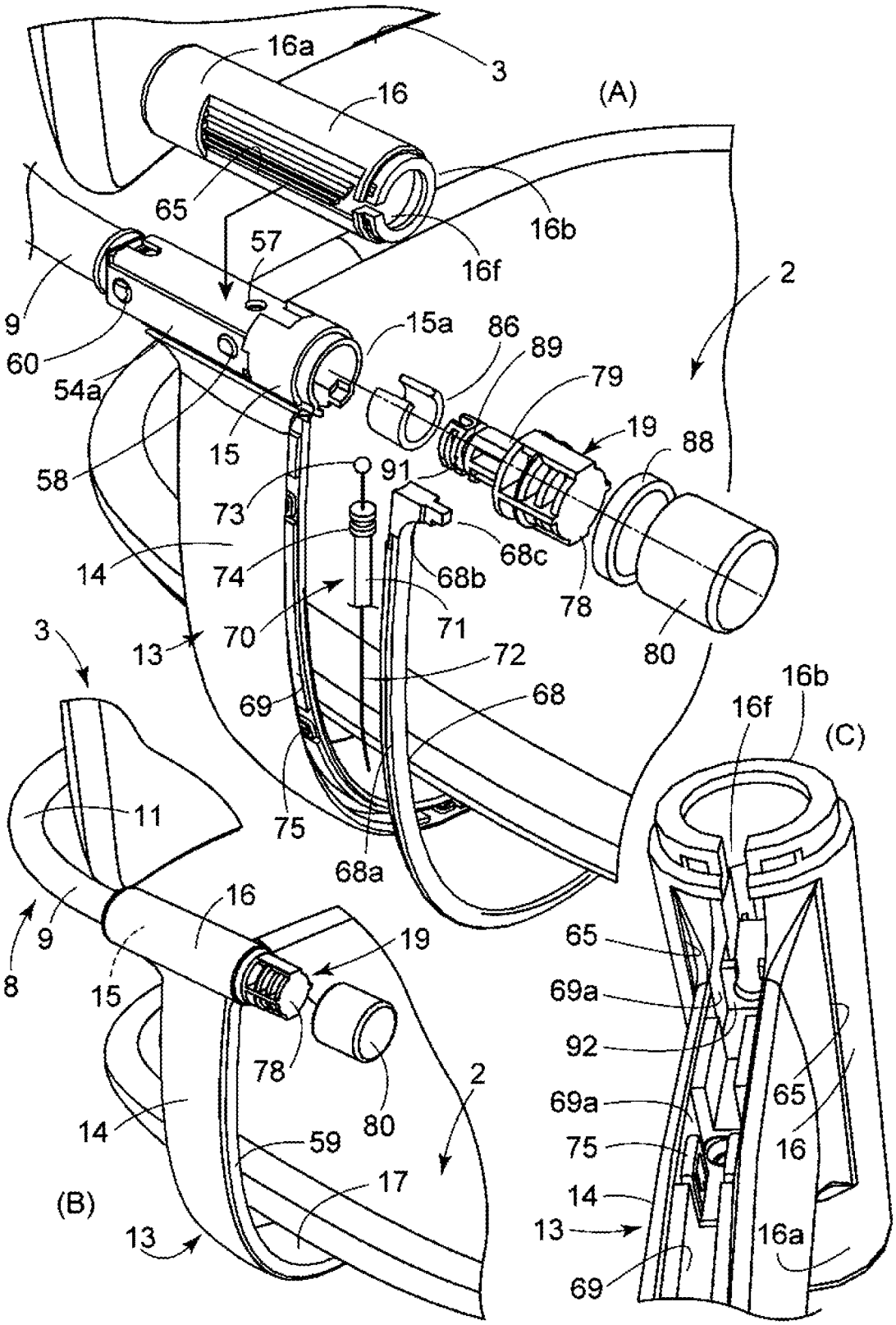
FIG. 12 is compsed of section (A) to (C), where the sections (A) and (B) are exploded perspective views of a lock release operation portion of the pedestal as viewed from above and front, and the section (C) is a partial perspective view of a side support body on a right side as viewed from below.
Figure 13:
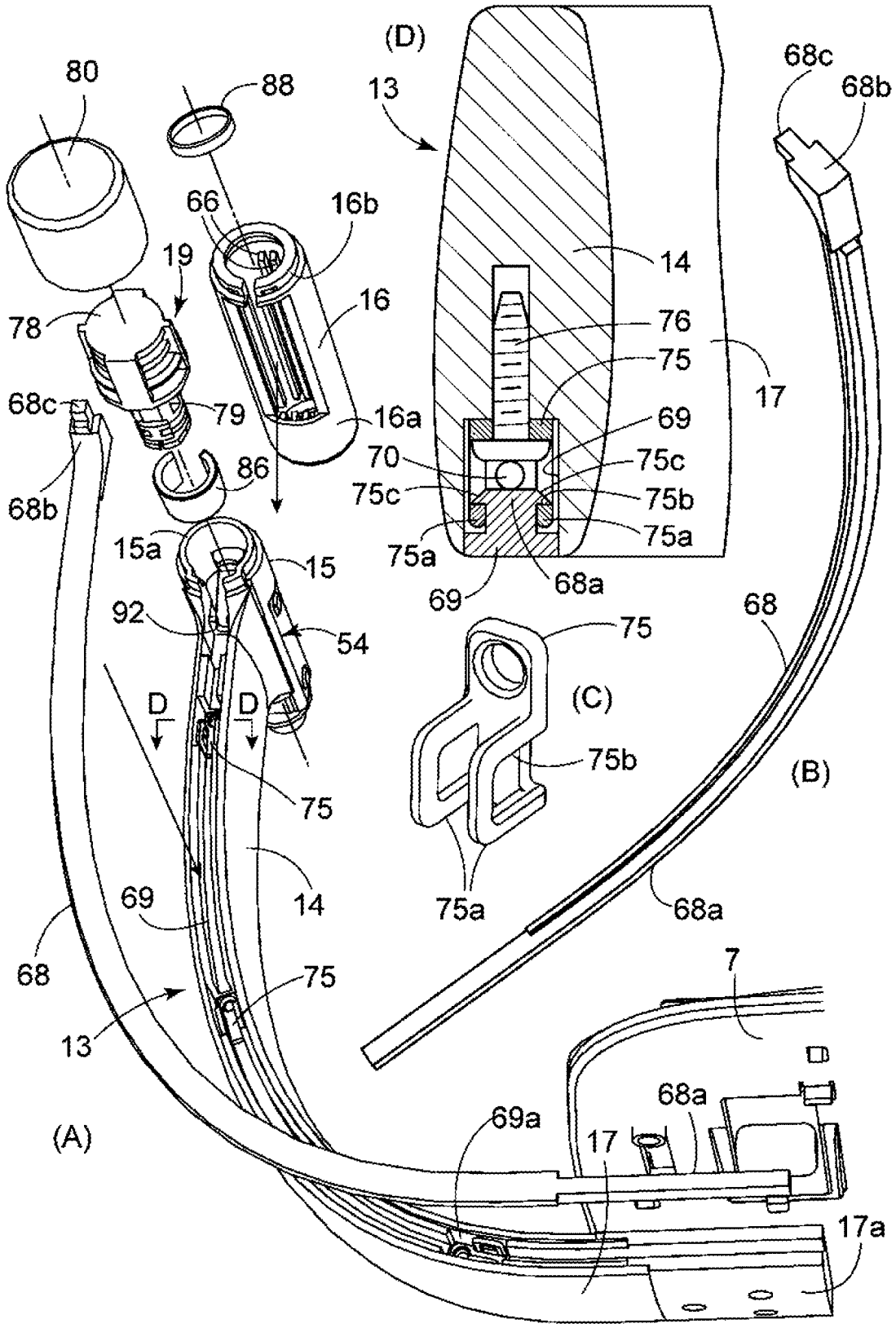
FIG. 13 is composed of a section (A) which is a exploded perspective view of the lock release operation portion as viewed from the lower front, a section (B) which is a perspective view of a groove cap as viewed from the rear, a section (C) which is a perspective view of a groove cap holder, and a section (D) which is a cross-sectional view taken along the line D-D of the section (A) of FIG. 13 with the groove cap attached.

As illustrated in the sections (A) of FIGS. 12 and 13, on the front surface of the side support body 13, a long groove 69 closed by a groove cap 68 is formed over the entire length and an operation cable 70 partially illustrated in FIG. 12 is arranged in the long groove 69.

The operation cable 70 is well known and includes a tube 71 and a wire 72 slidably inserted therein. Both ends of the wire 72 are exposed to the outside of the tube 71 and a ball 73 is fixed to the tip of the exposed portion. Locking bodies 74 including an annular groove are fixed to both ends of the tube 71. As described above, when the knob 19 is rotated, one end of the wire 72 is pulled and the pedestal 5 is unlocked.

For example, as clearly illustrated in the section (D) of FIG. 13 the groove cap 68 includes an inwardly ridge 68*a* fitted into the long groove 69 and the ridge 68*a* is pinched and held from the left and right by a plurality of holders 75 arranged in the long groove 69 at appropriate intervals. As clearly illustrated in the section (C) of FIG. 12, the holder 75 is arranged in a wide width portion 69*a* of the long groove 69 and the ridge 68*a* of the groove cap 68 is also tightly fitted in the long groove 69. The groove cap 68 is provided with a flange to include the ridge 68*a*. The long groove 69 includes a step portion into which the flange of the groove cap 68 is fitted.

As clearly illustrated in the section (C) of FIG. 13, the holder 75 includes a pair of pinching portions 75*a* pinching the ridge 68*a*, and as illustrated in the section (D) of FIG. 13, the base portion is fixed to the bottom surface of the long groove 69 by a screw 76. The pinching portion 75*a* is formed in a frame shape which is open to the left and right and fits tightly into the long groove 69. Between the substrate of the holder 75 and the ridge 68*a* of the groove cap 68, there is a gap in which the operation cable 70 can be placed.

It is possible to fit only the ridge 68*a* of the groove cap 68 into the long groove 69. Here, the fitting strength in the long groove 69 may vary because of variation in dimension due to difference in molding shrinkage of the groove cap 68. On the other hand, when the holder 75 made of synthetic resin or a metal plate is used together as in the embodiment, even when the groove cap 68 has a variation in size, the groove cap 68 can be firmly fixed by utilizing the elastic deformation of the holder 75.

In particular, when the pinching portion 75*a* of the holder 75 is formed in a frame shape as in the embodiment, since the engagement claw 75*c* formed on the side surface of the ridge 8*a* of the groove cap 68 can be engaged with a hole 75*b* formed in the pinching portion 75*a* of the holder 75, the groove cap 68 can be easily attached while the groove cap 68 cannot be removed. In the long groove 69, a portion where the holder 75 is arranged includes a step portion cut off to widen the groove width.

As described above, the side support body 13 includes the base portion 17 which wraps around below the seat 2. As illustrated in FIG. 13, the groove cap 68 is formed over the entire length of the side support body 13. Of the base portion 17 of the side support body 13, a portion corresponding to a tip portion (fitting portion) 17*a* which fits into the engagement hole 18 of the base 6 is composed of only the ridge 68*a* and does not include a flange portion.

The reason is because the tip portion 17*a* of the base portion 17 of the side support body 13 is fitted exactly into the engagement hole 18 (see the section (D) of FIG. 1) formed in the base 6. Also in the groove cap 68, the flange portion is cut off at the portion fitted into the engagement hole 18. Since the ridge 68*a* is fitted in the engagement hole 18 of the base 6, the groove cap 68 is held in the lower part thereof to not come out forward.

(9) Basic Structure of Knob

The lock release operation portion is provided with the above-described knob 19 as a main member and the wire 72 is pulled by the rotation of the knob 19. The knob 19 is made of synthetic resin. As illustrated in FIG. 12, the knob 19 includes an operating portion 78 exposed in front of the upper horizontal portion 15 (and the protective cover 16) of the side support body 13 and a boss portion 79 which enters inside the upper horizontal portion 15 of the side support body 13. The operation portion 78 is covered with a cap 80 made of a soft material such as rubber.

Figure 14:
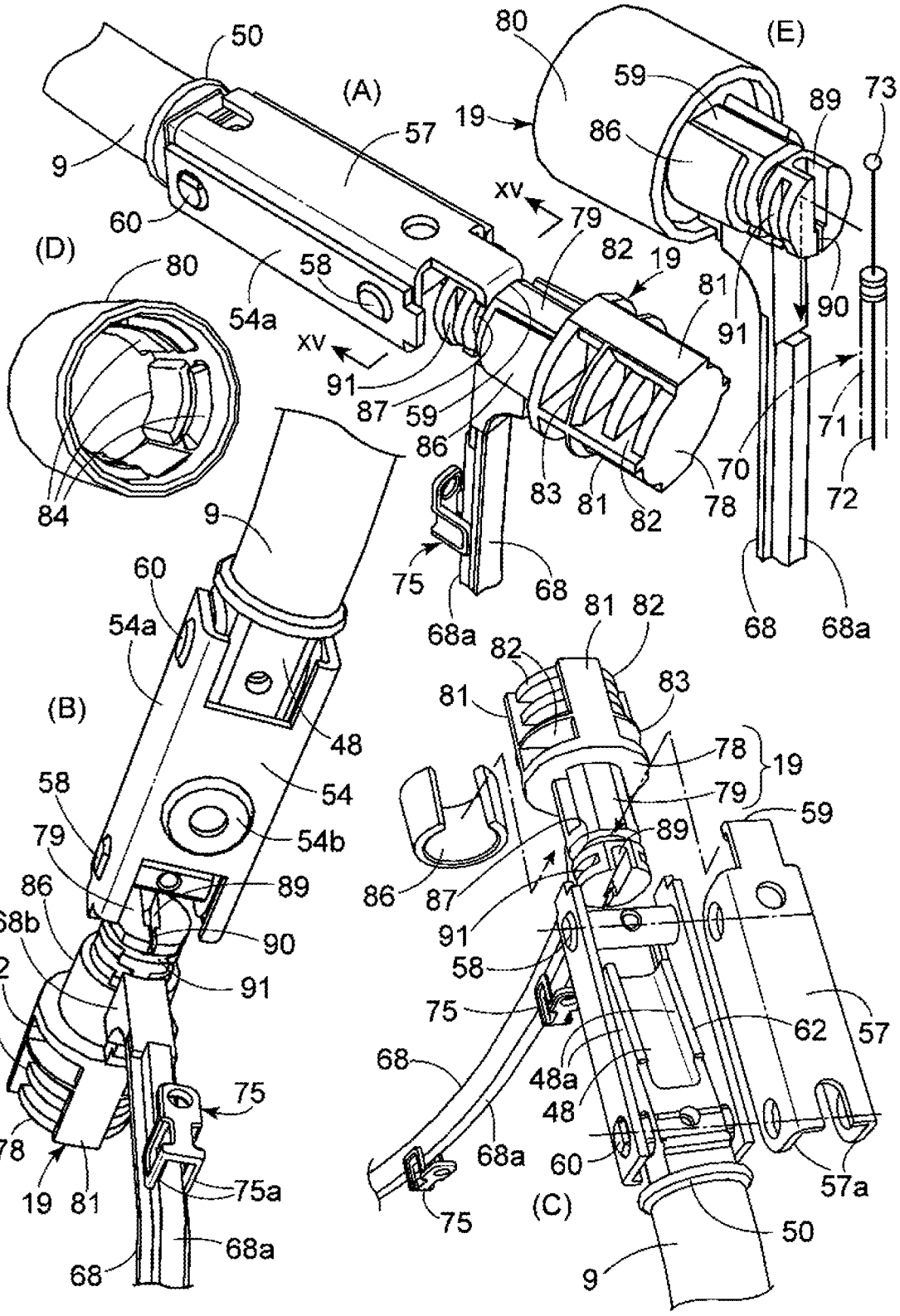
FIG. 14 is composed of views illustrating the lock release operation portion, where a section (A) is a perspective view as viewed from the upper front side, a section (B) is a perspective view as viewed from the rear lower side, a section (C) is a perspective view in which some members are separated and seen from the upper rear, a section (D) is a perspective view of a knob cap seen from the rear, and a section (E) is a perspective view illustrating a wire attaching procedure.

For example, as clearly illustrated in the section (A) of FIG. 14, on the outer peripheral surface of the operating portion 78 of the knob 19, a plurality of recess portions 82 separated by a plurality of vertical ribs 81 arranged at equal intervals in the circumferential direction are formed and the recess portion 82 is divided into front and rear by a lateral rib 83 which is long in the circumferential direction. As clearly illustrated in the section (D) of FIG. 14, a protrusion 84 which fits into the recess portion 82 of the operating portion 78 is formed on the inner surface of the cap 80.

The cap 80 is forcibly attached to the operating portion 78 against its elasticity and the group of the protrusions 84 is fitted in the group of the recess portions 82. The cap 80 is held so that the cap 80 cannot rotate relative to the operating portion 78 and cannot be pulled out forward. Since the cap 80 is made of rubber, when a user grips the cap 80 with his or her fingertip and rotates the cap 80, the fingertip does not slip.

The boss portion 79 has a smaller diameter than that of the operating portion 78, and a bearing bush 86 made of resin having low friction and excellent wear resistance is fitted in a portion of the boss portion 79 near the knob 19. Therefore, the boss portion 79 is rotatably held by the upper horizontal portion 15 of the side support body 13 via the bearing bush 86. That is, the presence of the bearing bush 86 enables the knob 19 to be easily rotated (the boss portion 79 does not come into contact with the upper horizontal portion 15 made of aluminum, and thus has high wear resistance). Although the bearing bush 86 is C-shaped, it may be formed in an annular shape (cylindrical shape).

For example, as illustrated in the section (A) of FIG. 14, an annular groove 87 is formed in a portion of the boss portion 79 behind the bearing bush 86 and the downward-directed hook portion 59 formed at the front end of the upper receiving bracket 57 is fitted into the annular groove 87 from above. Therefore, the knob 19 is held by the downward-directed hook portion 59 of the upper receiving bracket 57 to not move forward and backward. Since a slight gap exists between the downward-directed hook portion 59 and the annular groove 87, the rotation of the knob 19 is not hindered.

As a unit for holding the knob 19 so that the knob 19 cannot come off and is rotatable, for example, it is possible to adopt a dedicated screw which is screwed into the upper support frame 8 and insert the tip of the screw into the annular groove 87. When the downward-directed hook portion 59 of the upper receiving bracket 57 is used as in the embodiment, the number of members can be reduced.

The diameter of the operating portion 78 of the knob 19 is larger than that of the boss portion 79, and as illustrated in the sections (A), (B) and (E) of FIG. 14, a head portion 68*b* which abuts the lower surface of the bearing bush 86 is formed at the upper end of the groove cap 68. The head portion 68*b* is projected toward the front and a narrow engagement protrusion 68*c* is formed on the front end surface of the head portion 68*b*, and the engagement protrusion 68*c* is fitted with a split groove 16*f* formed at the front end portion of the protective cover 16. Therefore, the head portion 68*b* of the groove cap 68 is held by the protective cover 16 so that the groove cap 68 cannot be pulled out forward.

Eventually, the groove cap 68 is held by the holder 75 at a plurality of positions while the upper and lower parts of the groove cap 68 are held to not come out forward. Therefore, although the groove cap 68 has a simple structure to fit in the long groove 69 from the front side, the groove cap 68 can be firmly held to not come out in the front side.

As illustrated in FIG. 12, a small diameter portion 15*a* is formed at the front end of the right upper horizontal portion 15, and altogether, a small diameter portion 16*b* is also formed at the front end portion of the protective cover 16. Then, a ring 88 illustrated in the section (A) of FIG. 12 is fitted to the small diameter portion 16*b* of the protective cover 16. Therefore, the front end of the protective cover 16 is held by the ring 88 so that the front end cannot be opened.

(10) Pulling Structure of Ball by Knob

For example, as illustrated in the sections (E) and (C) of FIG. 14, at a part of the boss portion 79, which is the part of the rear and portion behind the annular groove 87, a ball holding groove 89 into which the ball 73 of the operation cable 70 fits from the back and a wire insertion groove 90 communicating with the ball holding groove 89 are open to the rear. In a part of the boss portion 79, which is the part on the front side of the ball holding groove 89, a pair of left and right wire holding grooves 91 communicating with the wire insertion groove 90 is formed.

Figure 15:
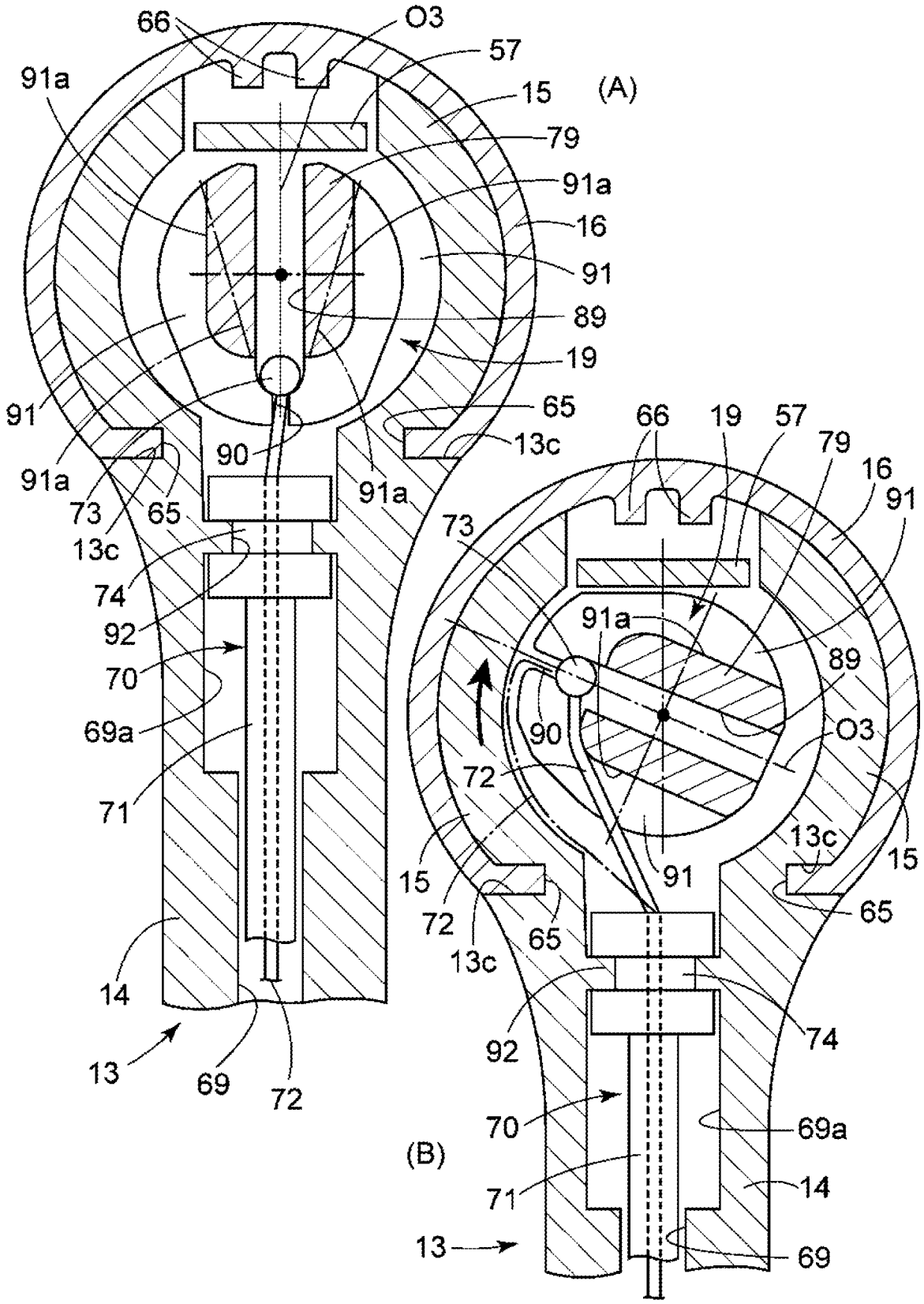
FIG. 15 is composed of sections (A) and (B) which are cross-sectional views taken along the line XV-XV in the section (A) of FIG. 14, where the section (A) illustrates a locked state, and the section (B) illustrates an unlocked state.

The wire holding groove 91 opens toward the outer periphery of the boss portion 79. As illustrated in FIG. 15, an inner surface 91*a* of the wire holding groove 91 is aligned with a vertically long center line O3 passing through the axis center of the boss portion 79.

As illustrated in FIG. 15 (see also the section (C) of FIG. 12), the upper part of the long groove 69 has the wide width portion 69*a* and the locking body 74 provided at the upper end of the tube 71 is fitted and attached to a constricted rib 92 formed in the wide width portion 69*a*.

When the knob 19 is rotated to the left or right, the ball 73 is pulled upward and wire 72 is pulled (rolled up). Here, when an inner surface 91*a* of the wire holding groove 91 has an arc shape, the wire 72 bends sharply near the ball 73 and the locking body 74, as illustrated by the alternate long and short line in the section (B of FIG. 15. Therefore, not only the durability of the wire 72 is deteriorated, but also the slidability of the wire 72 with respect to the tube 71 is deteriorated, which may make it difficult to smoothly rotate the knob 19.

On the other hand, when the inner surface 91*a* of the wire holding groove 91 is brought closer to the longitudinal centerline O2 as in the embodiment, the bending of the wire 72 is significantly prevented. Therefore, the durability of the wire 72 can be improved and the slidability of the wire 72 with respect to the tube 71 can be prevented from being deteriorated so that the knob 19 can be easily rotated. In the embodiment, since the lower end of the inner surface 91*a* of the wire holding groove 91 is rounded, the left and right inner surfaces 91*a* form a U shape (J shape when only one is viewed). As illustrated by the alternate long and short line in the section (A of FIG. 15, it is possible to form the inner surface 91*a* linearly so that the left and right inner surfaces 91*a* can form a V-shape.

(11) Significance of Knob Position

In the chair (rotary chair) composed of pedestal 5 with a gas cylinder, providing an operating portion member for unlocking the pedestal 5 in the armrest device is disclosed in, for example, JP-A-2007-105293. In JP-A-2007-105293, a button-shaped operating portion member (finger hanging portion) which is pushed up is arranged on the lower surface of the elbow rest. The operating portion member is provided at the front end of the rotary lever, and when the operating portion member is pushed up, the lever rotates, and the rotation of the lever is transmitted to a push valve pushing member via the wire inserted in the tube (Background art).

Operating portion members such as levers and buttons which unlock the pedestal 5 are often placed on the side of the seat. When the operating portion member is provided in the elbow rest as in JP-A-2007-105293, there is no need to move the hand to the side portion of the seat, which has the advantage of good operability.

However, when the operating portion member is arranged on the lower surface of the elbow rest as in JP-A-2007-105293, the user of the seat puts his or her forearm in a posture close to the vertical and puts the fingertip on the operating portion member. Thus, there is a problem that the arm bends unnaturally and the user is easily burdened. When the operating portion member is on the lower surface of the elbow rest, the visibility may be poor, and thus a situation may occur in which the user searches around the operating portion member.

People sometimes hold the elbow rest firmly when they sit on or stand up from the chair. When the operating portion member is arranged on the lower surface of the elbow rest as in JP-A-2007-105293, if the elbow rest is firmly held, the operating portion member could be accidentally pulled and the lock might be released. The embodiment also aims at improving such a current situation. (Problem).

Then, in the embodiment, in order to solve the above-described problem, the knob 19 is provided at the front end of the upper horizontal portion 15 which is long in the front-rear direction. With such configuration, the chair user can rotate the knob 19 in a natural state without raising the forearm so much, and thus the burden on the person when adjusting the height of the seat can be reduced (Effect).

Since the knob 19 is arranged at a position easily seen by the user, the user can easily understand the function of the knob 19 and adjust the height of the seat 2. Even when a person firmly holds the upper horizontal portion 15, the knob 19 does not rotate. Thus, there is no unforeseen situation in which the pedestal 5 is accidentally unlocked when a person is sitting or standing while holding the upper horizontal portion 15. Therefore, safety is excellent (Effect).

In the embodiment, the knob 19 is a rotary type, but a rotary type which is pushed vertically or horizontally or a button type which is pushed backward can also be adopted. It is possible to adopt a mode in which the knobs 19 are provided in the upper horizontal portions 15 of the left and right side support bodies 13 and the lock is released by operating any of the knobs 19.

(12) Significance of Operation Cable Arrangement

As described above, JP-A-2007-105293 discloses disposing a button-shaped operating portion member (hanging portion) on the lower surface of the elbow rest. In the present publication, an operation cable for transmitting the movement of the operating portion member to the push valve pushing member is arranged inside the elbow strut portion (Background art).

Placing the operation cable inside the armrest device has the advantage of being aesthetically pleasing. Since the elbow strut portion has to be formed into a hollow structure with a plurality of members, there are problems that the structure may be complicated and that it is difficult to apply it to the thin elbow strut. The embodiment also has an issue of improving the current situation regarding the arrangement of operation cables (Problem).

Then, in the embodiment, regarding the arrangement of the operation cable 70, the long groove 69 in which the operation cable 70 is arranged is formed on the outer surface of the upper horizontal portion 15 and the long groove 69 is closed by the groove cap 68. (Means for Solving the Problem).

According to the structure, since it is not necessary to form the side support body 13 in a hollow structure, the structure can be simplified and the cost can be reduced. Even when the side support body 13 is, for example, a die cast product, the structure can be easily applied. Even when the side support body 13 is thin, the structure can be applied without deteriorating the strength by forming a long groove on the front surface or the rear surface (Effect).

As in the embodiment, when forming a long groove over the entire length of the side support body 13 and exposing the base portion 17 of the side support body 13 to the inside of the base 6, it is possible to significantly prevent the exposure of the operation cable 70. Thus, it is possible to prevent an object from being caught by the operation cable 70 in a chair assembly work or the like.

As described above, when a holder is also used as a holding unit for the groove cap 68, even when there is a processing error in the groove cap 68 or the side support body 13, the processing error can be absorbed and firmly fixed. When the upper end and the rear end of the groove cap 69 are held to not come off as in the embodiment, the fixing strength can be further improved. It has already been stated that the groove cap 69 can be firmly attached using the holder 75.

(13) Significance of Wire Holding Groove

The operating portion member for releasing the lock of the pedestal (gas cylinder) includes the button type and lever type as in the publication described above. Even in the button type, the wire can be pulled smoothly because the member is rotated to pull the wire. However, as described above, when a button-type operating portion member is placed on the lower surface of the elbow rest, there is a possibility that the user may be confused due to poor visibility or the operating portion member may be accidentally pulled when the elbow rest is gripped for some reason. (Background art).

On the other hand, when the rotary knob 19 is placed in an outwardly exposed state on a member which is placed higher than seat like the elbow rest, the visibility is excellent and the user's confusion can be eliminated, and even when the user holds the elbow rest firmly, there is no problem that the lock is accidentally released. It is innovative in design.

Then, when configured such that the wire 72 is pulled (rolled up) by the rotary knob 19, as described with reference to the section (B of FIG. 15, when the inner surface 91*a* of the wire holding groove 91 is formed in an arc shape, the rotation of the knob 19 causes the wire 72 to bend sharply, which may reduce the durability of the wire 72 or cause the movement of the wire 72 to be performed unsmoothly. In the embodiment, improvement of the current situation is one of the issues (Problem).

In order to eliminate the problem described above, in the embodiment, the inner surface 91*a* of the wire holding groove 91 formed in the rotary knob 19 has a structure that the inner surface 91*a* is brought closer to the longitudinal centerline O3 passing through the axis center of the knob 19 (Means for solving the problem).

With such a configuration, as described above, the degree of bending of the wire 72 can be reduced, so that the durability of the wire 72 can be improved and the smooth sliding of the wire 72 with respect to the tube 71 can be secured (Effect).

In the embodiment, the lock is released by rotating the knob 19 in either the left or right direction, but the lock may be released only by rotating in one direction. As described above, it is possible to provide the knobs 19 on the left and right side support bodies 13. The arrangement position of the knob 19 is not limited to the upper horizontal portion 15 of the side support body 13. For example, it is also possible to arrange the knob 19 on the lateral side of the seat 2 or the seat receiving member 7 to rotate around the axis center extending in the left-right direction.

(14) Significance of Protective Cover

Design Registration No. 1627516 discloses that an arm projecting forward from the backrest is connected to the side support body so that the arm can be tilted rearward. As described above, the side support body is just a pillar, so the elbow rest function cannot be expected, and it is not possible for a person to grasp the upper end of the side support body by hand when sitting on or standing up from a chair (Background art).

On the other hand, when the side support body 13 is provided with the upper horizontal portion 15 extending in the front-rear direction and an upper support frame 8 is connected to the upper horizontal portion 15 to be tiltable, there is an advantage that the upper horizontal portion 15 can be used as an elbow rest or a gripping member. The upper horizontal portion 15 can be used as a mounting member using the knob 19 to unlock the pedestal 5.

Here, it is necessary to cover the upper horizontal portion 15 with the cover because appearance and safety problems occur if the upper horizontal portion 15 remains exposed. Since the upper support frame 8 tilts, when the cover is made of synthetic resin, if covering the upper horizontal portion 15 while allowing the movement of the upper support frame 8, the upper support frame 8 may become considerably large. In the embodiment, one of the issues is to improve the current situation (Problem).

In the embodiment, the entire upper horizontal portion 15 and the front portion of the upper support frame 8 are covered with a protective cover 16 made of a soft material of elastomer (Means for solving the problem).

With such structure, while keeping the protective cover 16 in close contact with the upper horizontal portion 15 and the upper support frame 8, it is possible to allow tilting of the upper horizontal portion 15. Therefore, it is possible to tilt the upper support frame 8 in a safe state while making the protective cover 16 compact. Since the protective cover is made of a soft material such as elastomer, it is possible to place the elbow of the seated person and make the upper horizontal portion 15 function as an elbow rest (Effect).

As in the embodiment, it is preferable to form a tubular portion at the rear portion of the protective cover and fit the tubular portion to the front portion of the upper support frame 8 from the outside so that the protective cover can be prevented from coming off. Here, the protective cover 16 can be raised and deformed with the protective cover attached to the upper support frame 8. Therefore, while attaching the protective cover 16 to the upper support frame 8 in advance, the upper support frame 8 can be attached to the upper horizontal portion 15, being one of the excellent effects of the embodiment.

As in the embodiment illustrated in FIG. 8, when the protective cover 16 is formed in a front opening and divided by the front slit 16*c* and the opening portion and the front slit 16*c* are closed by the front cap 67, it is particularly preferable because the protective cover 16 can be held to not be rolled while ensuring the ease of molding. The same applies when the ring 88 is used as illustrated in FIG. 12.

When the groove cap 68 is attached to the side support body 13, the forward movement of the upper end of the groove cap 68 can be prevented by the protective cover 16 as described above. That is, the protective cover 16 can also be used as a stopper for preventing the groove cap 68 from coming off. Thus, the protective cover 16 can be used for various purposes.

As illustrated in FIG. 15, a side edge of the opening portion 65 of the protective cover 16 projects inward, and the projecting portion fits into an engagement groove 13*c* formed in the side support body 13. Therefore, the protective cover 16 is tightly fitted to the side support body 13 in a state where the protective cover 16 cannot be rolled up even when a person touches with hands.

(15) Mounting Procedure for Upper Support Frame and Knob

The upper support frame 8 is connected by the following procedure, for example. That is, first, as a pre-process, the pushing bracket 48 is previously fixed to the side portion 9 of the upper support frame 8, while the side support body 13 is fixed to the base 6. The protective cover 16 is previously fitted into the side portion 9 of the upper support frame 8.

Then, the upper and lower receiving brackets 57 and 54 and the pushing bracket 48 are inserted by the rear support shaft 60 and the second elastic body 61 is fitted between the pushing bracket 48 and the upper receiving bracket 57. Then, the lower receiving bracket 54 is fixed to the upper horizontal portion 15 with the screw 55, and then, in the example of FIG. 11, the upper receiving bracket 57 is fixed to the rectangular block 52 with the front screw 63. When the front screw 63 is screwed into the rectangular block 52, the second elastic body 61 is gradually pressurized and precompression is performed.

In the example of FIGS. 8 to 10, after pinching the second elastic body 61 between the lower receiving bracket 54 and the pushing bracket 48, the second elastic body 61 is precompressed by pushing the upper receiving bracket 57 downward by hand or a jig, and then, in that state, the front support shaft 58 is inserted to connect the upper and lower receiving brackets 57 and 54 and the rectangular block 52. In any case, after the upper support frame 8 is connected to the upper horizontal portion 15, the protective cover 16 is moved forward and fitted into a predetermined state.

The knob 19 is attached in the following procedure. First, the operation cable 70 is pulled out from the engagement hole 18 of the base 6 and meanwhile, the side support body 13 is attached to the base 6. Then, after locking the knob 19 to the upper end of the wire 72, the operation cable 70 is fitted into the long groove 69 of the side support body 13 and the knob 19 is fitted into the upper horizontal portion 15. Next, the groove cap 68 is attached to the long groove 69 and the knob 19, and then the protective cover 16 is attached and the ring 88 is fitted, and finally, the cap 80 is attached to the knob 19.

At the place where the knob 19 is provided, the knob 19 is inserted into the upper horizontal portion 15, and then the upper and lower receiving brackets 57 are fixed, in such a manner that the downward-directed hook portion 59 provided on the upper and lower receiving brackets 57 will be fitted into the annular groove 87 of the knob 19.

(16) Pedestal Lock Release Mechanism Portion of Seat Portion

Next, the structure of the seat portion will be described. First, mainly with reference to FIGS. 16 to 19, a lock release mechanism portion of the pedestal 5 and a structure related thereto will be described.

Figure 17:
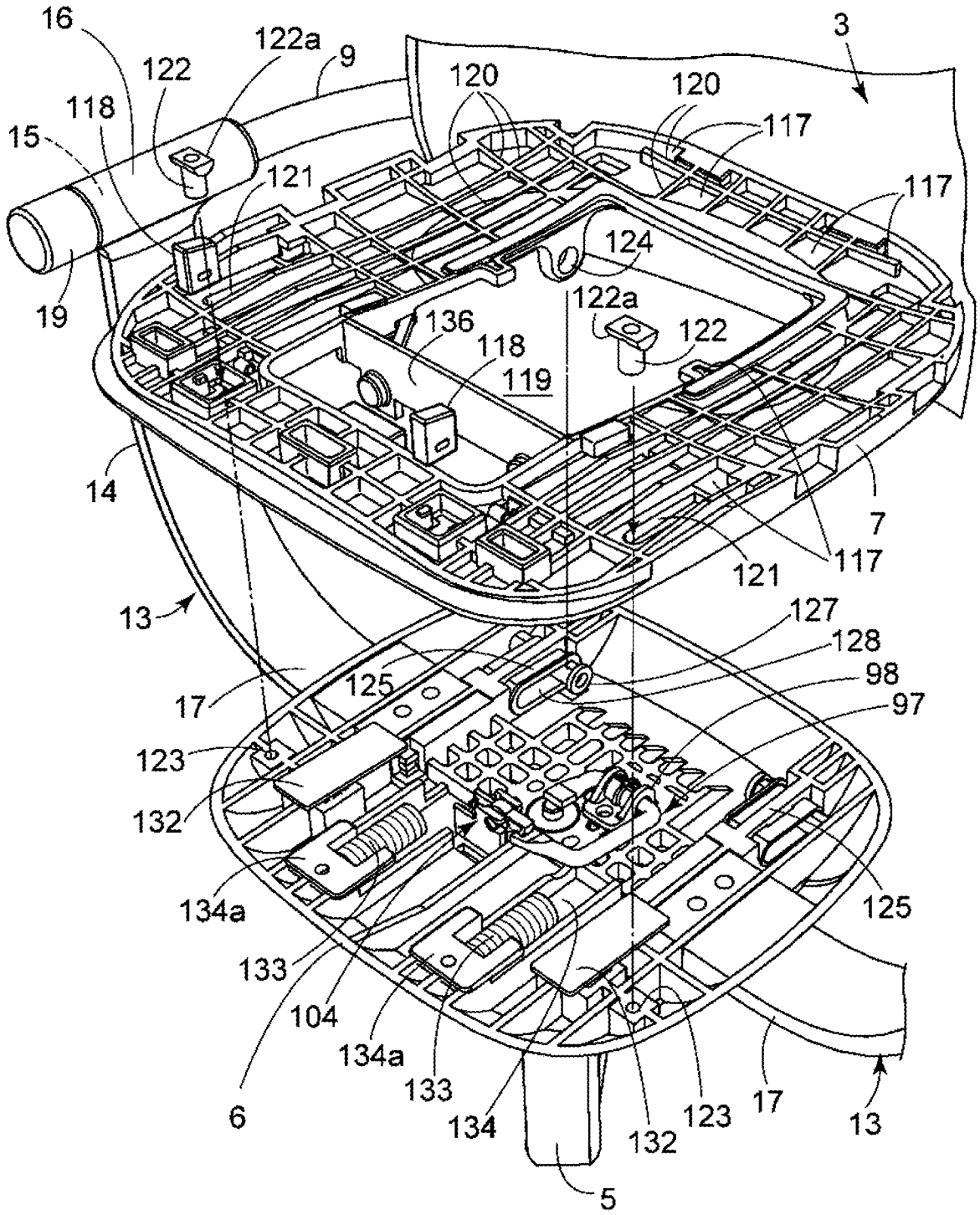
FIG. 17 is a perspective view in a state where the seat receiving member is separated from the base.

As illustrated in FIG. 17, the base 6 is in the shape of a shallow tray which is substantially square in a plan view and opens upward. As illustrated in the section (A) of FIG. 19, a boss hole 94 into which the upper end of the pedestal 5 (more accurately, the inner cylinder of the gas cylinder which constitutes the pedestal 5) is fitted from below is formed in the approximate center of the base 6. In order to secure the necessary height for the boss hole 94, a downward cylindrical portion 95 is formed on the base 6. The inner peripheral surface of the boss hole 94 and the outer peripheral surface of the upper portion of the pedestal 5 are tapered so that the diameter is reduced upward. As the taper angle, a general Morse taper is adopted.

Figure 18:
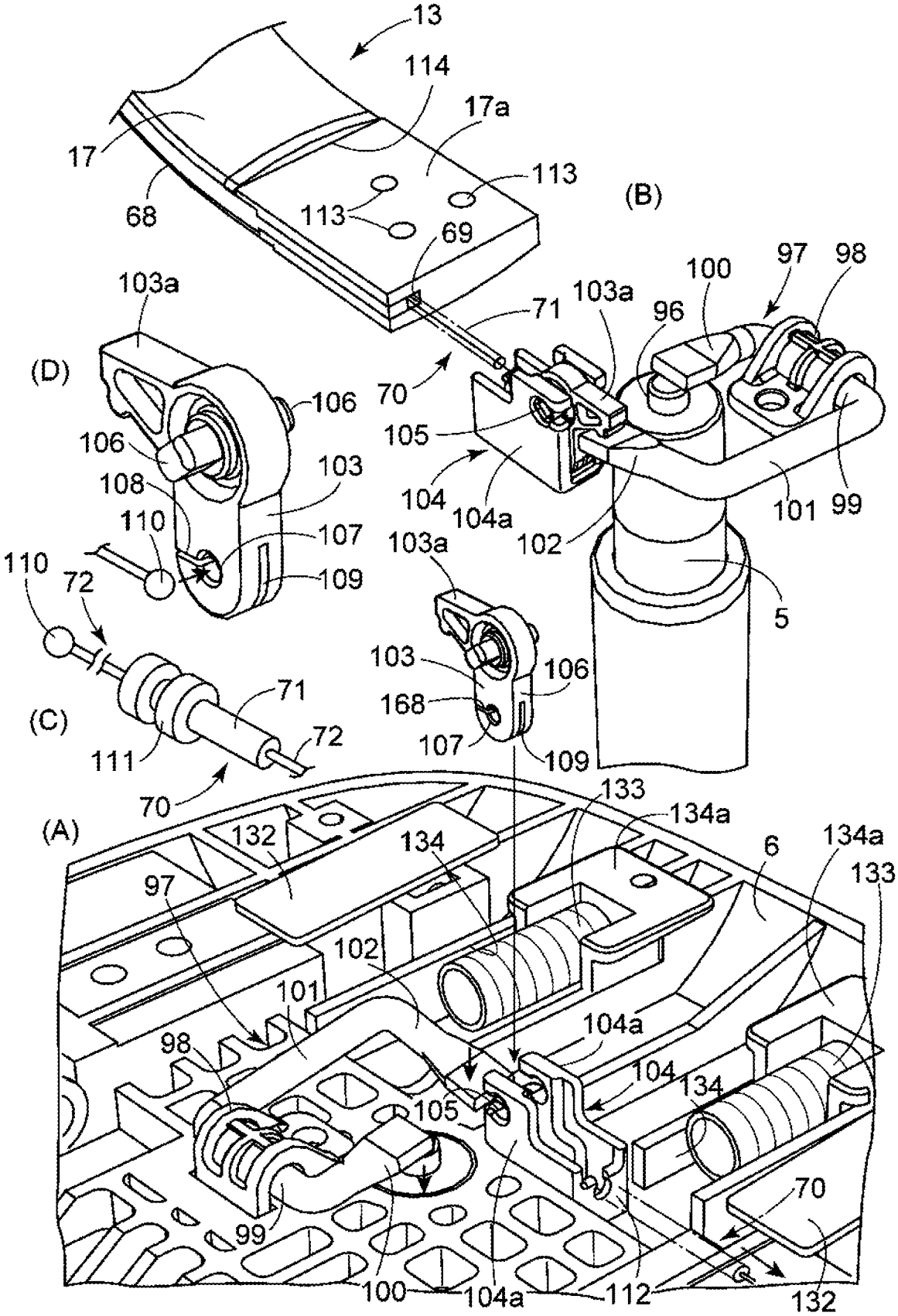
FIG. 18 is composed of views illustrating a lock release mechanism portion of the gas cylinder, where a section (A) is a perspective view in which a lever is separated, a section (B) is a perspective view in which the base is omitted, a section (C) is a perspective view of an end portion of an operation cable, and a section (D) is a perspective view in which the lever and the operation cable are separated.
Figure 19:
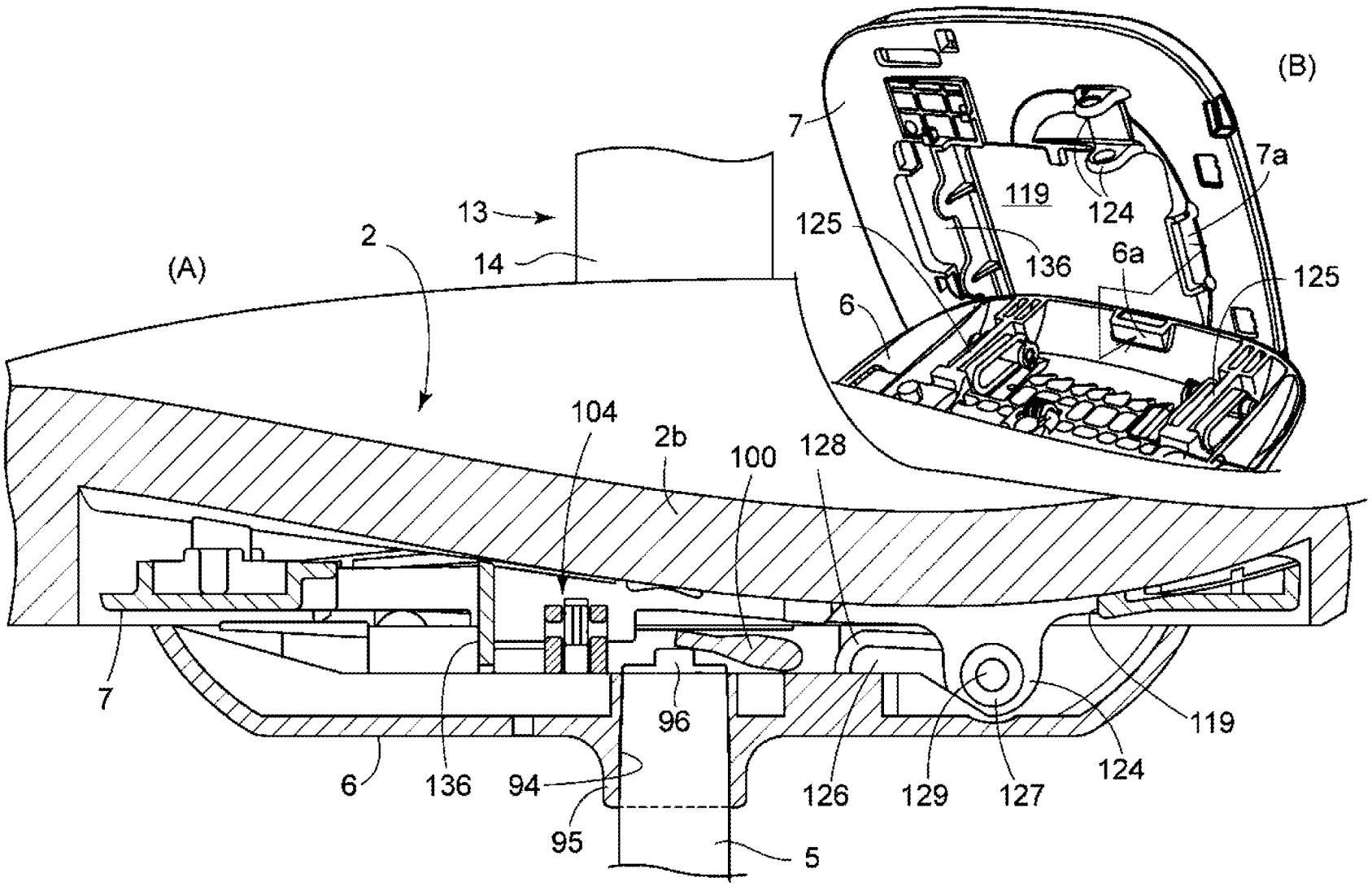
FIG. 19 is composed of a section (A) which is a vertical cross-sectional side view of a left-right central portion of the seat portion and a section (B) which is an exploded perspective view of another example.

For example, as illustrated in the section (A) of FIG. 19, and the sections (A) and (B) of FIG. 18, a push valve 96 for unlocking is provided on the upper end of the pedestal 5 in a protruding manner and a push valve pushing member 97 for pushing the push valve 96 is arranged on the base 6.

As illustrated in the sections (A) and (B) of FIG. 18, the push valve pushing member 97 includes a support shaft portion 99 which is long in the left-right direction and rotatably held by a first bracket 98 fixed to the base 6, a tip arm portion 100 which is long in the front-rear direction and extends forward from the right end of the support shaft portion 99 toward the top of the push valve 96, an intermediate portion 101 extending forward from the left end of the support shaft portion 99, and a base end arm portion 102 which is formed at the rear end of the intermediate portion 101 in a bending manner and extends parallel to the support shaft portion 99. The tip portion of the tip arm portion 100 is flattened and is in contact with the push valve 96 from above.

A second bracket 104, which rotatably holds a crank lever 103 having an inverted L-shape in a front view, is fixed to a portion of the upper surface of the base 6 opposite to the first bracket 98 with the pedestal 5 interposed therebetween by a screw. The second bracket 104 includes front and rear side plates 104*a*. A bearing hole 105 opened toward the base end arm portion 102 of the push valve pushing member 97 is formed in the front and rear side plates 104*a* by slitting and the support shaft 106 provided on the crank lever 103 is fitted into the bearing hole 105.

The crank lever 103 has an inverted L shape, includes a lateral-directed portion 103*a*, and the lateral-directed portion 103*a* is in contact with the base end arm portion 102 of the push valve pushing member 97 from above. The base end arm portion 102 of the push valve pushing member 97 is also flattened.

In the downward portion of the crank lever 103, a ball holding hole 107 and a wire insertion groove 108 opened rearward, and a wire holding groove 109 opened downward in communication with those are formed. The ball 110 provided at the other end of the wire 72 is fitted into the ball holding hole 107 and the wire 72 is pulled out sideways.

As illustrated in the section (C) of FIG. 18, the locking body 111 including the annular groove 111*a* is attached to the other end of the operation cable 70 and the locking body 111 is attached to the constricted rib 112 (see the section (A) of FIG. 18) provided on the side of the second bracket 104 opposite to the bearing hole 105.

As illustrated in the section (B) of FIG. 18, the other end of the operation cable 70 is pulled out from the long groove 69 of the side support body 13. Then, when the wire 72 is pulled by the rotation operation of the knob 19, the crank lever 103 rotates and the lateral-directed portion 103*a* pushes the base end arm portion 102 of the push valve pushing member 97 downward. Next, the push valve pushing member 97 rotates and the tip arm portion 100 pushes down the push valve 96 of the pedestal 5. Thus, the pedestal 5 is unlocked and the height of the seat 2 can be adjusted.

As clearly illustrated in the section (B) of FIG. 18, the other end (lower end) of the wire 72 of the operation cable 70 is pulled out from the long groove 69 formed in the side support body 13 in a substantially linear posture toward the second bracket 104. Therefore, the operation cable 70 has a linear posture in a plan view. The side support body 13 is slightly curved when viewed from the front, so the operation cable 70 is also gently curved. There is no sharp bend in the operation cable 70 due to the synergistic effect that the operation cable 70 has a linear posture in a plan view and is gently curved in a front view. Therefore, almost no sliding resistance is generated between the wire 72 and the tube 71. As a result, the crank lever 103 can be lightly pushed by the rotation of the knob 19.

As illustrated in the section (B) of FIG. 18, in the tip portion 17*a* of the base portion 17 of the side support body 13 that enters the engagement hole 18 of the base 6, there are a plurality of mounting holes 113 through which the fixing screws pass. A stepped portion 114 for positioning is formed outside the tip portion 17*a*.

(17) Structure Centered Mainly on Seat Receiving Member in Seat Portion

Figure 16:
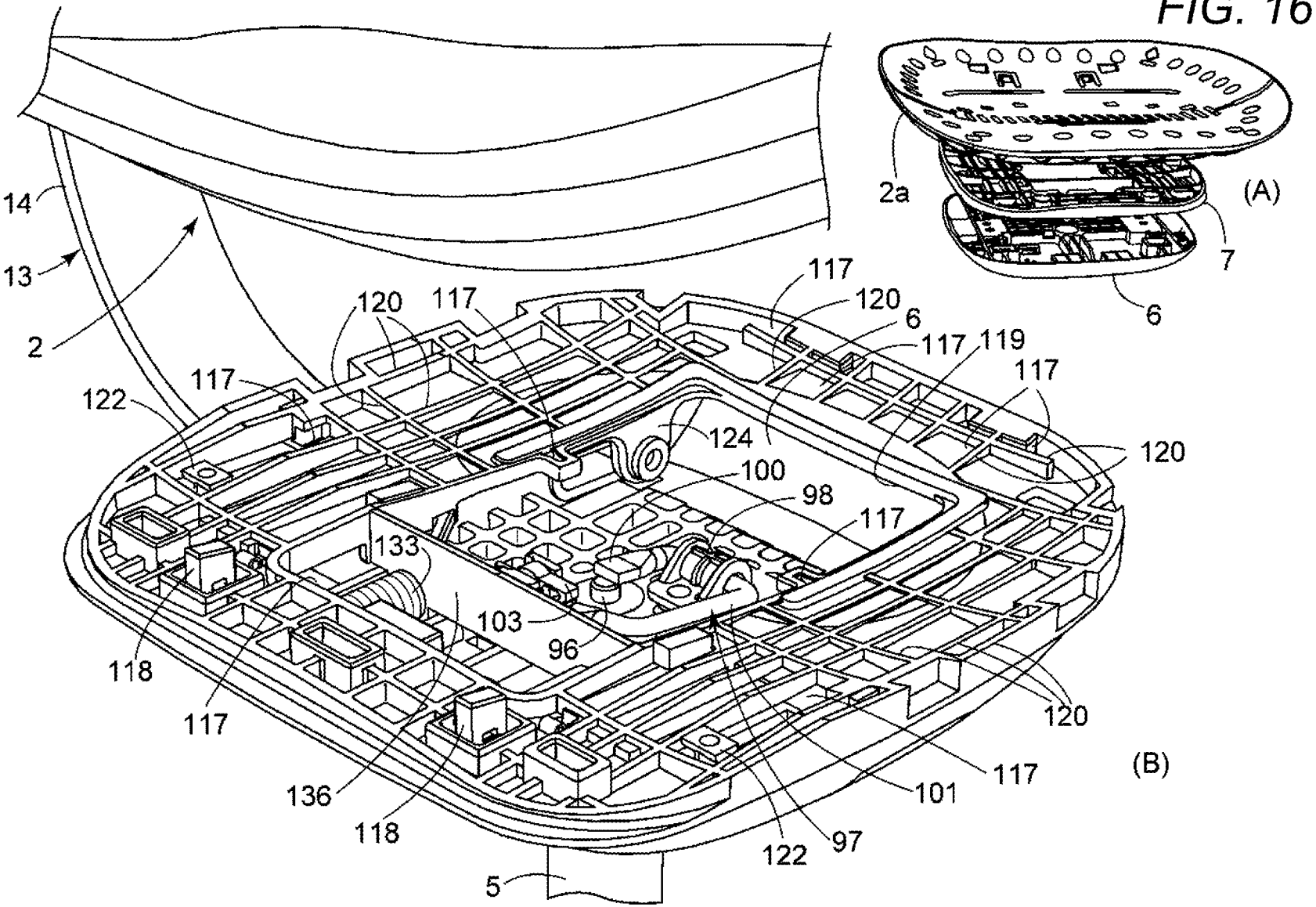
FIG. 16 is composed of a section (A) which is an exploded perspective view of a main member constituting a seat portion, and a section (B) which is a perspective view in which the seat is separated to expose a seat receiving member.

Next, the structure related to the seat receiving member 7 will be described with reference also to FIGS. 20 to 22. The section (A) of FIG. 16 illustrates a seat inner shell 2*a* that constitutes the seat 2. The seat 2 includes the seat inner shell 2*a* and, for example, a seat cushion 2*b* illustrated in the section (B) of FIG. 19, and the seat cushion 2*b* is covered with a skin material (not illustrated). The seat inner shell 2*a* can be tilted forward with a hinge portion provided on the front portion as a fulcrum. Therefore, the seated person is cared to not feel pressure on the thigh even when the seat 2 moves forward and rises.

As illustrated in the section (B) of FIG. 16 and FIG. 17, the front and rear portions of the seat receiving member 7 are formed with a group of a plurality of engagement holes 117 to which a downward engagement claw provided on the seat inner shell fits and engages. An elastic body 118 which supports the seat inner shell is arranged at the front of the seat receiving member 7. As illustrated in the section (B) of FIG. 16 and FIG. 17, the seat receiving member 7 includes a large opening portion 119 having a quadrangular shape in plan view formed in the central portion. The seat receiving member 7 has a shallow tray-like form and a large number of reinforcing ribs 120 extending vertically and horizontally are formed inside.

As already described, the seat receiving member 7 is attached to base 6 to be capable of sliding back and forth. Therefore, as a slide unit, first, for example, as illustrated in FIG. 17, on the left and right sides of the front part of the seat receiving member 7, oblong holes 121 are formed to penetrate vertically in the front-rear longitudinal direction and a guide body 122 inserted through the oblong holes 121 is fixed to the base 6. The guide body 122 is formed with a flange 122*a* which holds the seat receiving member 7 upwardly inseparably and is fixed to the base 6 by a screw (not illustrated). Therefore, the tap hole 123 into which the screw is screwed is formed in the base 6.

For example, as illustrated in FIGS. 17 to 18, a pair of left and right bearing pieces 124 are projected downward at two positions on the left and right of the rear part of the seat receiving member 7. In the base 6, a support rib 125 which is long in the front-rear direction and pinched by the pair of bearing pieces 124 is formed and a guide hole 126 which is long in the front-rear direction is formed in the support rib 125. A guide shaft 127 which is long in the left-right direction is inserted through a bush 128 into the pair of bearing pieces 124 and the guide hole 126. Therefore, the rear part of the seat receiving member 7 is connected to the base 6 to be slidable back and forth. The bush 128 is made of a resin having excellent abrasion resistance and has a considerably large lateral width in order to improve durability.

Figure 22:
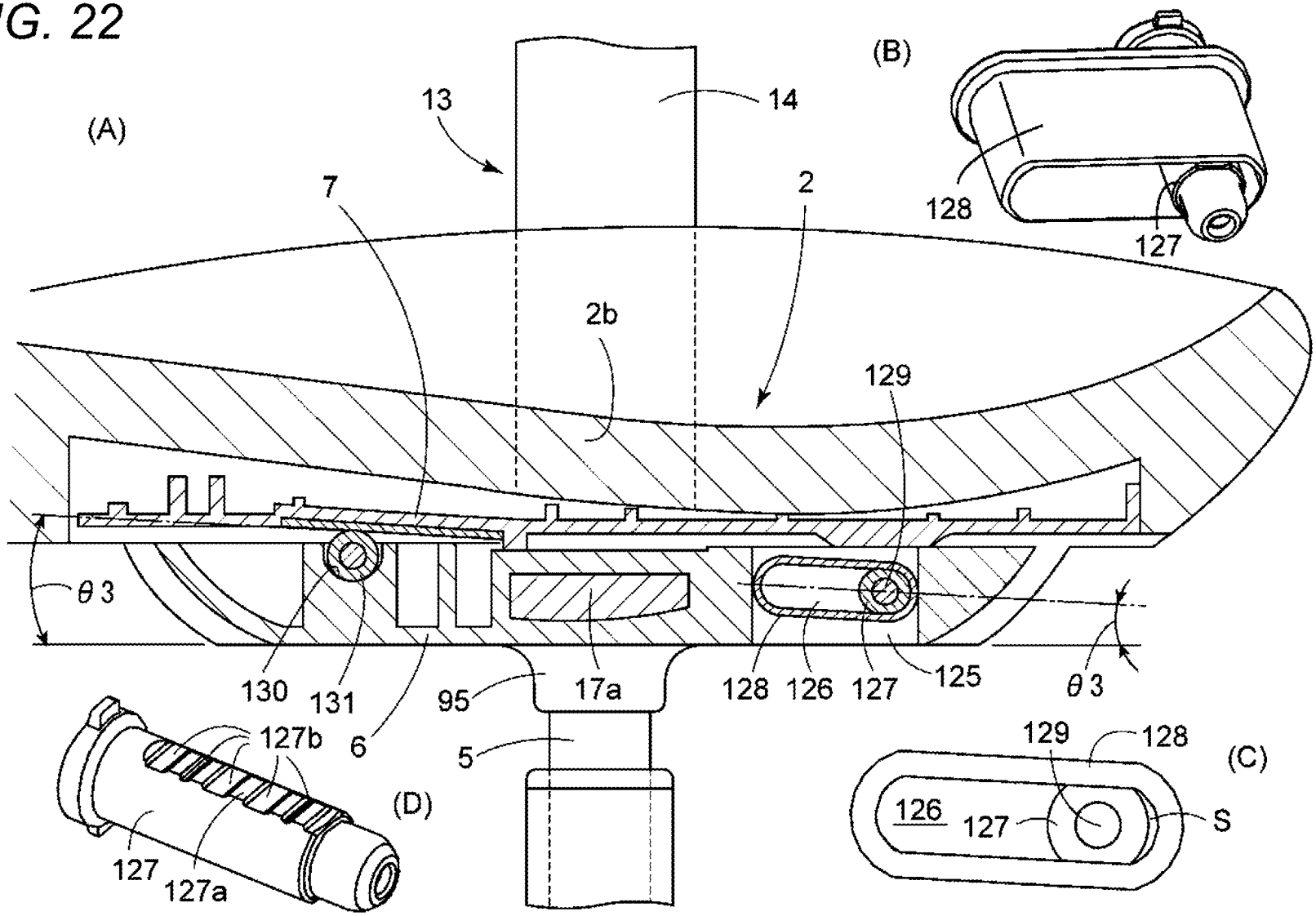
FIG. 22 is composed of a section (A) which is a cross-sectional view of the seat portion viewed from the XXII-XXII viewing direction of FIG. 20, a section (B) is a perspective view of only a bush and a guide shaft, a section (C) is a side view of the bush and the guide shaft in a state where the seat is fully retracted in another example, and the section (D) is a perspective view of the guide shaft.

For example, as illustrated in FIG. 22, the guide shaft 127 has a hollow structure and a mandrel 129 made of metal or the like is inserted therein. Although the mandrel 129 is a measure for improving the strength, the entire guide shaft 127 may be formed in a solid structure. As illustrated in FIG. 22, a flat surface 127*a* is formed on the guide shaft 127 and the flat surface 127*a* is set to make surface contact with the bush 128 (In FIG. 20, the flat surface 127*a* faces forward and backward, but actually, the flat surface 127*a* faces up and down as illustrated in FIG. 22). Therefore, the frictional resistance between the guide shaft 127 and the bush 128 can be reduced, and thus the movement of the guide shaft 127 can be made smooth.

As illustrated in the section (D) of FIG. 22, a groove 127*b* which is long in the direction orthogonal to the axis center is formed on the flat surface 127*a* of the guide shaft 127. When formed as such, the guide shaft 127 slides in contact with the guide hole 126 in a state close to line contact, so that the smoothness of movement of the guide shaft 127 can be significantly improved. It is possible to apply grease to the contact surface between the guide shaft 127 and the bush 128, and here, a groove 127*b* can hold the grease.

In the section (A) of FIG. 22, the guide shaft 127 is in a fully retracted state and the guide shaft 127 hits the rear end of the guide hole 126. In a modification example illustrated in the section (C) of FIG. 22, a slight gap S is set between the guide shaft 127 and the rear end of the guide hole 126 when the guide shaft 127 is fully retracted. On the other hand, in a modification example in the section (B) of FIG. 19, a fixed stopper rib 6*a* with a substantially vertical posture is provided behind the base 6 and on the wall part, while at the rear part of the seat receiving member 7, a movable stopper rib 7*a* that overlaps the stopper rib 6*a* from the front is provided. A cushioning sheet (not illustrated) such as a rubber plate or a sponge plate is attached to either or both of them. Therefore, when the seat 2 (and the seat receiving member 7) have fully retracted, it is possible to prevent the guide shaft 127 from hitting the rear end of the guide hole 126 and generating an impact sound.

Figure 20:
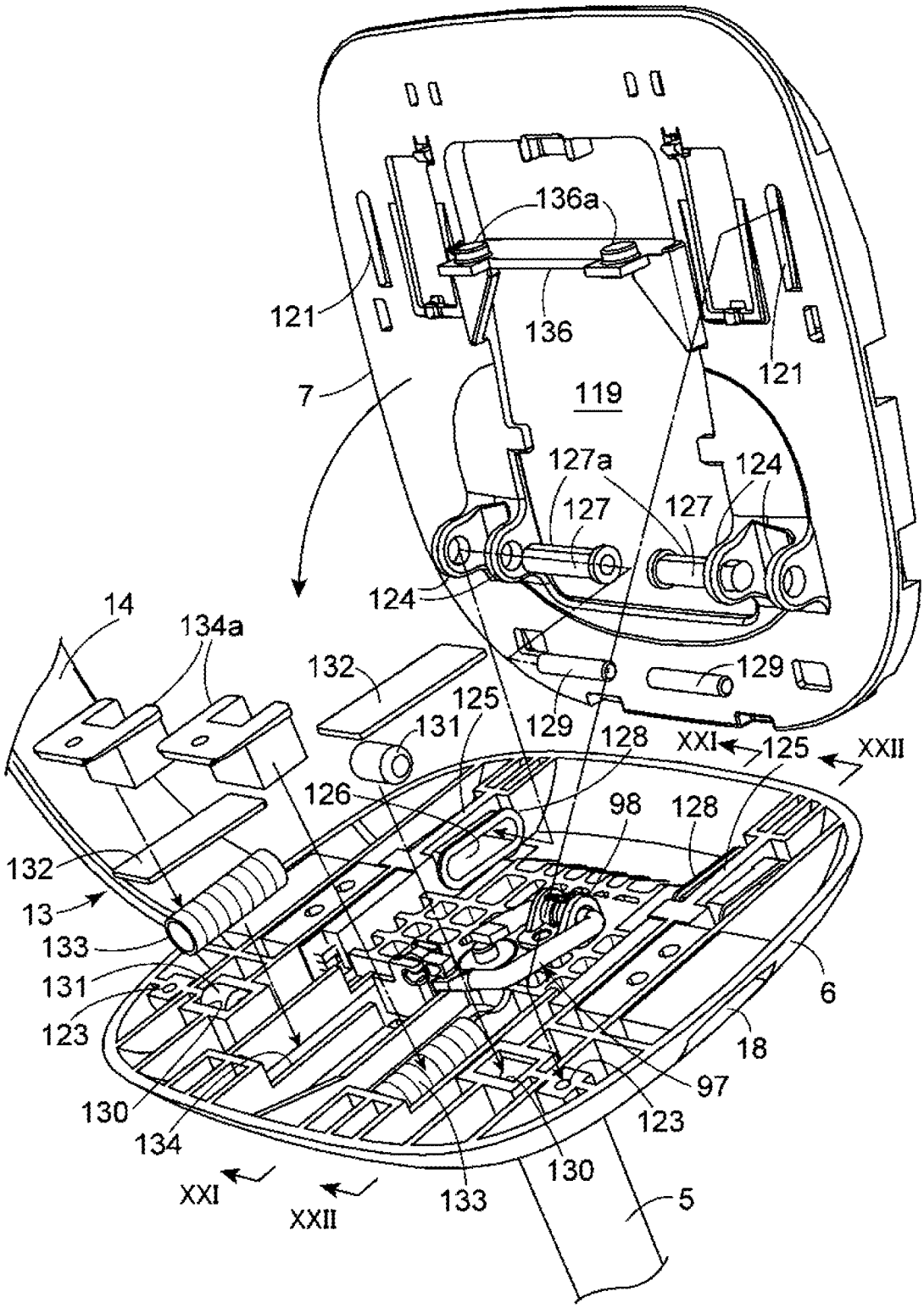
FIG. 20 is an exploded perspective view of the seat receiving member turned over.

As illustrated in FIGS. 20 and 22, a pair of right and left roller receiving recess portions 130 which open upward are formed at the front part of the base 6 and rollers 131 having the axial center extending in the left-right direction are rotatably arranged in the roller receiving recess portions 130. The seat receiving member 7 is supported by the left and right rollers 131. A reinforcing plate 132 made of metal or the like which abuts the roller 131 from above is attached to a recess portion formed on the lower surface of the seat receiving member 7.

As clearly illustrated in the section (A) of FIG. 22, in the embodiment, the guide hole 126 (and the bush 128) and the reinforcing plate 132 are inclined at a slight angle θ3 with respect to the horizontal plane to be higher toward the front. Therefore, the seat 2 and the seat receiving member 7 move forward while slightly rising.

Figure 21:
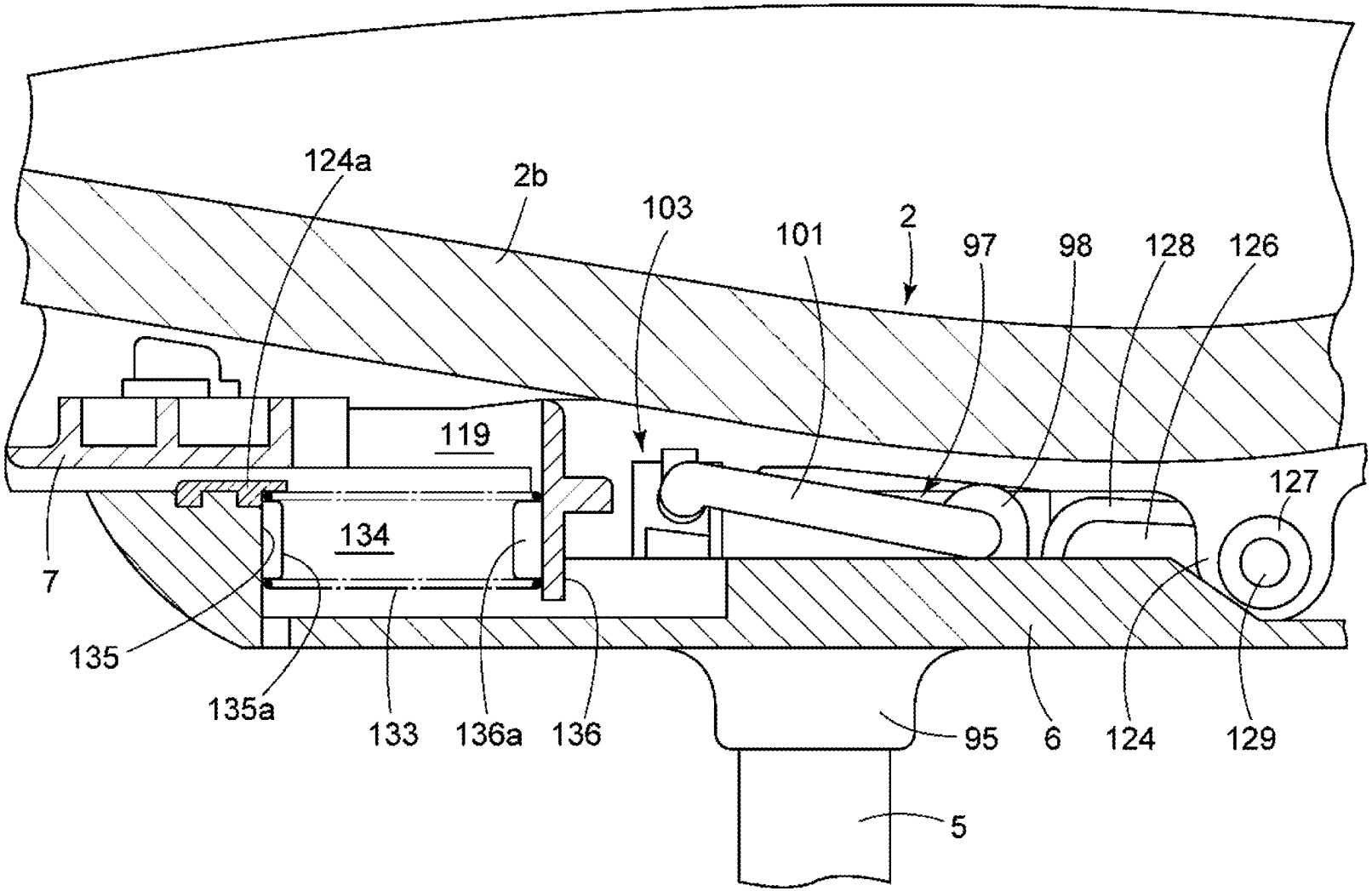
FIG. 21 is a cross-sectional view of the seat portion viewed from the XXI-XXI viewing direction of FIG. 20.

As illustrated in FIGS. 20 and 21, a spring (compression coil spring) 133 having a longitudinal length in the front and rear direction is arranged at a part of the base 6, which is the part close to the front side, as an elastic body which imparts elastic resistance to forward movement of the seat receiving member 7. The spring 133 is arranged in a spring receiving groove 134 formed on the base 6, and as illustrated in FIG. 21, the front end is supported by a front wall surface 135 of the spring bearing groove 134, and further the rear end is supported by a rear spring receiving 136 provided in the seat receiving member 7.

The rear spring receiver 136 is arranged to cross the opening portion 119. A front wall surface 135 and the rear spring receiver 136 are formed with protrusions 135*a* and 136*a* for holding the spring 133 to not be displaced. The spring 133 is arranged in a pre-compressed state. The front portion of the spring 133 is held immovably upward by a stopper 134*a* fixed to the base 6.

(18) Significance of Slide Mechanism of Seat Receiving Member

In the type of chair where a seat and a backrest are separated, a configuration in which the seat is pushed forward when the user tilts the upper body backward is disclosed in, for example, micro film of JP-UM-A-1986-123756, a micro film of JP-UM-A-1987-85239, and JP-UM-B-1986-2364. In JP-UM-A-1986-123756 and JP-UM-A-1987-85239, a rail portion which supports the front and rear slides of the seat 2 is in a horizontal posture. In JP-UM-B-1986-2364, the tubular support body for supporting the seat is inclined obliquely upward and the weight of the seated person acts to retract the seat. Therefore, it can be said that the seat can be retracted without increasing the elastic restoring force of the spring.

BACKGROUND ART

In the configuration in which the seat independently slides back and forth, the seat is biased in the retracting direction by the spring, and when the seated person raises the upper body, the seat is retracted by the spring. However, since the weight of the seated person acts on the seat, when the rail portion is in the horizontal posture as in JP-UM-A-1986-123756 and JP-UM-A-1987-85239, there is a problem that the seat, which does not use a spring having a large elastic restoring force, is difficult to retract. When a spring having a large elastic restoring force is used, a new problem arises in that it is difficult for a person with a light weight to move the seat forward.

In JP-UM-B-1986-2364, since the tubular support body for supporting the seat is inclined obliquely upward. Therefore, since the weight of the seated person acts to retract the seat, it can be said that the seat can be retracted without increasing the elastic restoring force of the spring. However, in JP-UM-B-1986-2364, a back strut is erected from the rear ends of the left and right tubular support bodies and a backrest is connected to the back strut so that the backrest can be tilted backward. As a result, there is a problem that design freedom is low. In the embodiment, solving such a problem is also one of the problems (Problem).

As a unit for solving the above-described problem, in the embodiment, as clearly illustrated in FIG. 22, the guide hole 126 and the reinforcing plate 132 are inclined to become higher toward the front. That is, in the embodiment, the guide portion which supports the seat receiving member 7 to be movable back and forth is inclined so that the seat receiving member 7 moves forward while moving upward. When the seat 2 moves back and forth with respect to the seat receiving member 7, the seat 2 is configured to move forward and rise (Means for Solving the Problem).

With such configuration, a part of the downward load due to seating acts as a component force for retracting the seat 2, so that the seat 2 can be retracted without increasing the size of the spring 133. Therefore, the seat 2 can be smoothly slid back and forth even when used by a person with a light weight. (Effect). It does not have to be a tubular support body as in JP-UM-B-1986-2364 and various slide structures can be adopted, so that it is excellent in versatility.

When the front portion of the seat receiving member 7 is supported by the rollers 131 as in the embodiment, the sliding resistance of the seat receiving member 7 can be further reduced, which is preferable. As described above, the flat surface 127*a* and the groove 127*b* of the guide shaft 127 can promote the resistance reducing effect.

(19) Another Example of Leg Device

Figure 23:
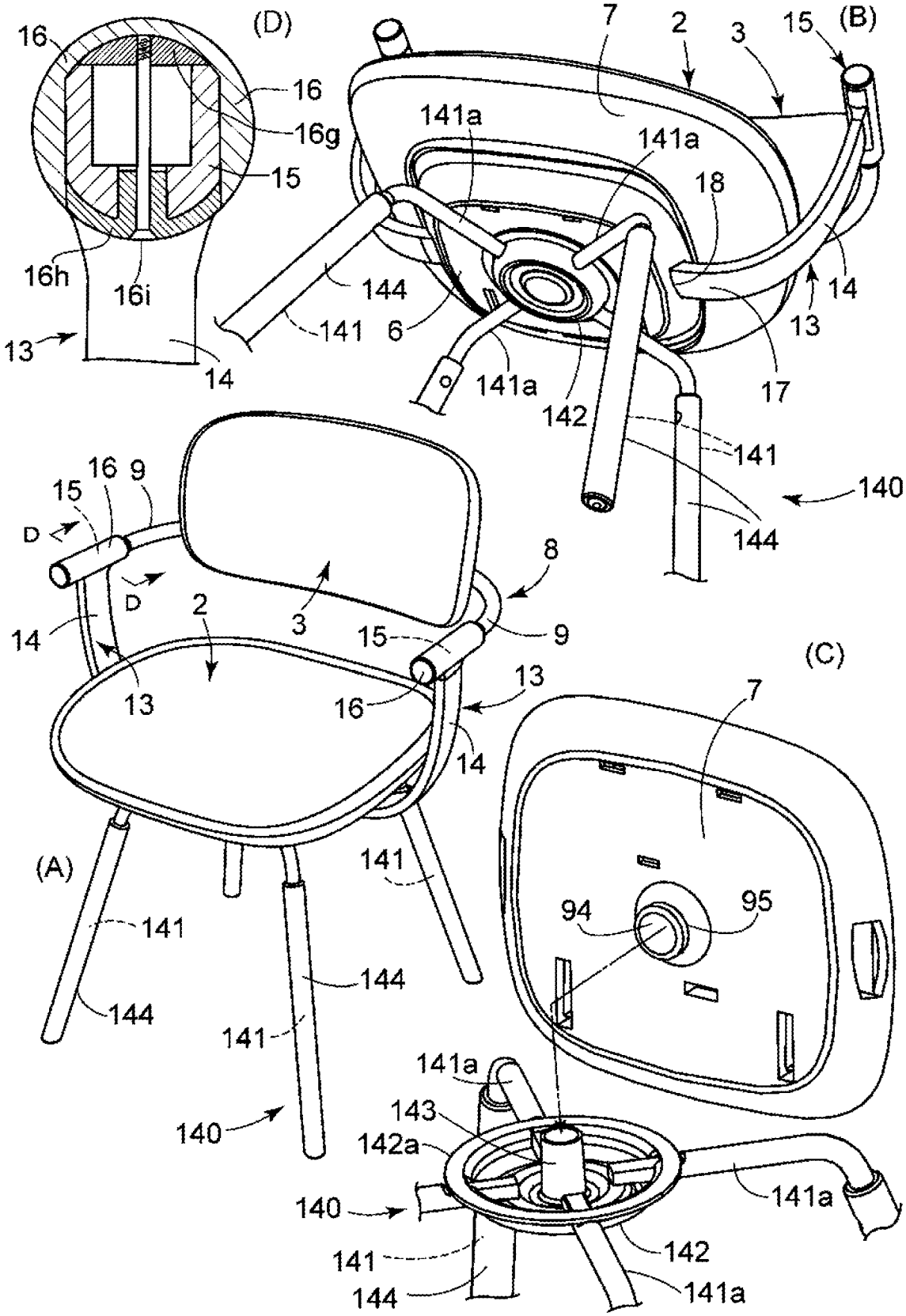
FIG. 23 is composed of views illustrating a second embodiment applied to a four-leg type leg device, where a section (A) is a perspective view seen from the upper front, a section (B) is a perspective view seen from the lower front, a section (C) is an exploded perspective view, and a section (D) is a cross-sectional view taken along the line D-D in the section (A) of FIG. 23.

In the above-described embodiment, the pedestal 5 formed of the gas cylinder is used as the leg device 1, but in the second embodiment illustrated in FIG. 23, the leg device 140 has four rod legs 141. Therefore, the chair of the second embodiment is non-rotating.

A horizontal portion 141*a* is formed by bending at the upper end of each rod leg 141 and the horizontal portion 141*a* is fixed to a bowl-shaped base 142 by welding. A tapered boss protrusion 143 fitted to the boss hole 94 of the seat receiving member 7 from below is fixed to the central portion of the base 142. Therefore, a chair equipped with a gas-cylinder-type leg device 1 and a chair equipped with a rod-leg-type leg device 140 share the same seat receiving member 7.

As a result, when preparing a plurality of types of chairs having different structures of the leg devices 1 and 140, it is possible to reduce the cost of members and assembly as a whole. When the leg device 140 is a rod-leg type, the knob 19 for adjusting the height of the seat 2 is not required. Therefore, both left and right side support bodies 13 do not have the long groove 69 or the groove cap 68 (The knob 19 may be left attached or the knob 19 may be attached and held non-rotatably.).

As illustrated in the section (C) of FIG. 23, the horizontal portion 141*a* of the rod leg 141 penetrates the lower part of the outer periphery of the base 142 and enters the inside of the base 142. Therefore, the base 142 is firmly fixed. The seat receiving member 7 is supported by a flange 142*a* provided on the base 142. Therefore, the seat receiving member 7 can be stably supported. The rod leg 141 is fitted with a decorative cylinder 144 made of wood or the like, but the rod leg 141 may be exposed.

It is also possible to attach a caster to the lower end of each rod leg 141. As the non-rotating type leg device, various forms other than the four rod-leg type can be adopted. For example, a U-shape in side view or a trapezoidal shape in side view can be adopted.

When the wooden decorative cylinder 144 is provided on the rod leg 141, the protective cover 16 provided on the upper horizontal portion 15 can be formed of wood. Here, since the wooden protective cover 16 cannot be deformed, the protective cover 16 is manufactured to have a downward opening as illustrated in the section (D) of FIG. 23, and thus is attached to the upper horizontal portion 15 from above.

As a fixing unit of the wooden protective cover 16, while a resin top member 16*g* is fixed to the upper inner surface by an adhesive, a lower cap 16*h* made of resin can be attached to the upper horizontal portion 15 from below and a screw 16*i* inserted in the lower cap 16*h* can be screwed into the top member 16*d*.

(20) Another Example of Rocking Mechanism

Figure 24:
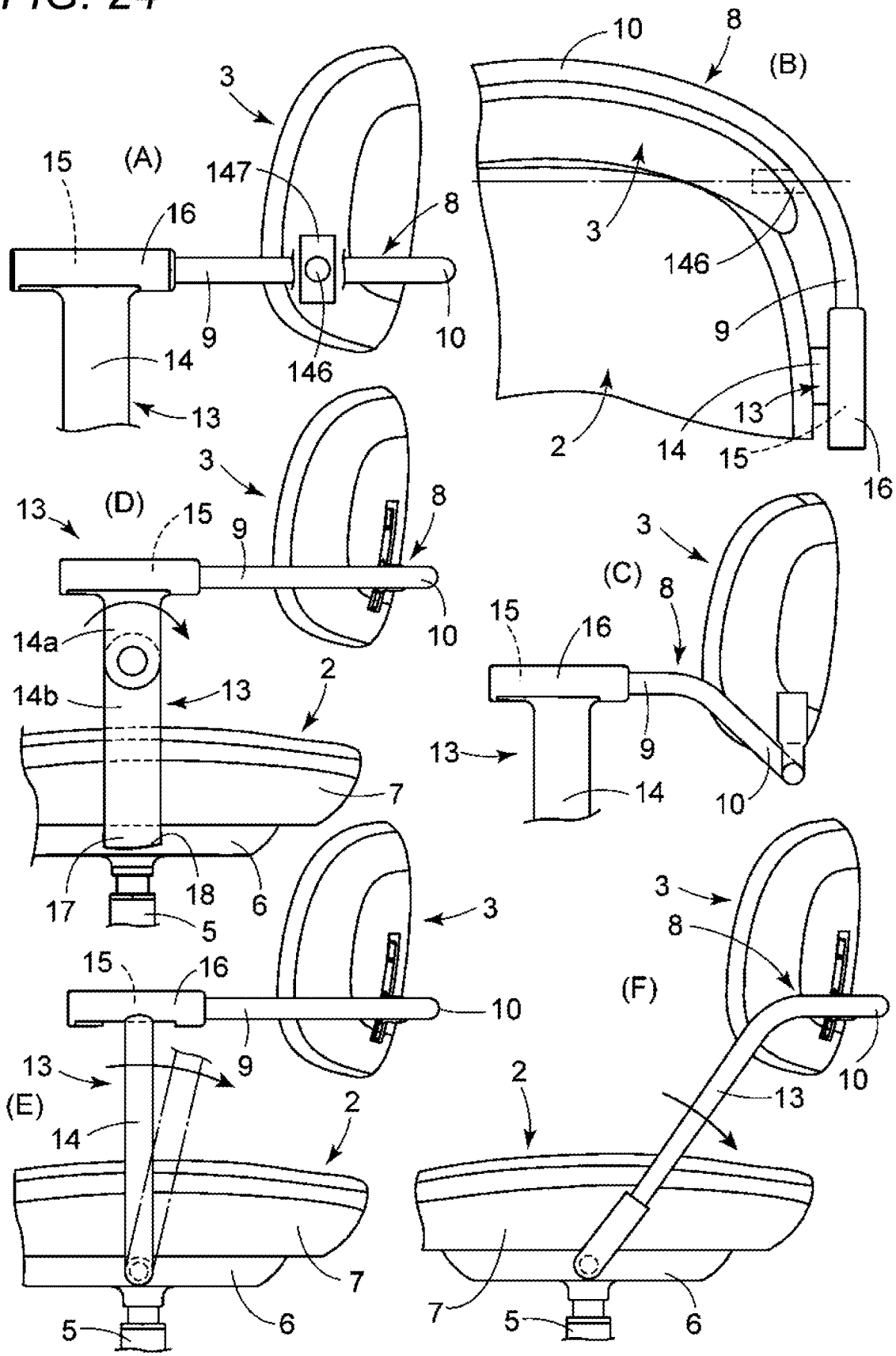
FIG. 24 includes sections (A) to (F) which views illustrating third to seventh embodiments, where the section (B) is a partial plan view in the section (A) of FIG. 24.

FIG. 24 illustrate other embodiments which are other examples of the rocking mechanism. Among them, in a third embodiment illustrated in the sections (A) and (B) of FIG. 24, the boss body 146 oriented in the left-right direction is provided in a corner portion 11 of the upper support frame 8 and the backrest 3 is rotatably connected to the boss body 146 by a bracket device 147 simply illustrated in the section (A) of FIG. 24. The other structure is the same as that of the first embodiment.

In the third embodiment illustrated in the section (C) of FIG. 24, the rear portion 10 of the upper support frame 8 is arranged below the backrest 3 and the same boss body 26 as in the first embodiment is attached to the rear portion 10 in an upward posture. In the embodiment, as the member for rotating the backrest 3, the same member as in the first embodiment is used with the posture changed by 90°. In the embodiment, since the rotation fulcrum of the backrest 3 is located in the lower part, the backrest 3 is more easily tilted backward than in the first embodiment.

In a fourth embodiment illustrated in the section (D) of FIG. 24, the upper-lower longitudinal strut portions 14 of the side support body 13 are vertically separated and an upper portion 14*a* is connected to a lower portion 14*b* in a state in which it can be tilted. An elastic body which provides resistance to tilting is built in. As the elastic body, it is also possible to use a spring in which both ends of a wire material wound in a loop shape are projected tangentially. The upper support frame 8 is fixed to not move relative to the upper horizontal portion 15 of the side support body 13.

In a fifth embodiment illustrated in the section (E) of FIG. 24 and a sixth embodiment illustrated in the section (F) of FIG. 24, the lower end of the side support body 13 is connected to the base 6 to be tiltable rearward. The backrest 3 tilts backward with respect to the upper support frame 8 as in the first embodiment.

In the fifth embodiment illustrated in the section (E) of FIG. 24, the side support body 13 has a side view T-shape as in the first embodiment. In the sixth embodiment of the section (F) of FIG. 24, the side support body 13 is composed of only the strut portion 14 extending in the up-down direction and the upper support frame 8 is integrally connected to the upper end. In FIG. 24E, the upper support frame 8 is fixed to the seat receiving member 7 of the side support body 13. In the examples of the sections (E) and (F) of FIG. 24, the backrest 3 retreats in the rocking state, so it does not necessarily have to move the seat 2 forward.

Although the embodiments of the present invention are described above, the present invention can be embodied in various other ways. For example, the present invention can be applied not only to a portable chair but also to a fixed chair such as a theater chair.

The present invention can be embodied in a chair. Therefore, it can be used industrially.

What is claimed is:

1. A chair comprising:

a seat;

a backrest separated from the seat; and an upper support frame to which the backrest is attached at a position higher than the seat, wherein the upper support frame includes:

a left side portion and a right side portion both extending forward at left and right sides of a seated person; and a rear portion that continuously and integrally connects the left side portion and the right side portion, the left side portion and the right side portion are respectively connected to left and right side support bodies arranged on left and right sides of the seat to be tiltable, the backrest is connected to the upper support frame to be tiltable rearward, each of the left and right side support bodies has a T-shape or an L-Shape in a side view, an upper horizontal portion extending longitudinally in a front-rear direction of the chair, and a strut portion extending longitudinally in an up-down direction of the chair, in a plan view, the upper horizontal portion of each of the left and right side support bodies is aligned with and connected to the respective side portion of the upper support frame along a straight line extending in the front-rear direction of the chair, and resistance when the backrest tilts rearward relative to the upper support frame is set to be larger than resistance when the upper support frame tilts relative to one of the side support bodies.

2. The chair according to claim 1, wherein the backrest is connected to the rear portion of the upper support frame.

3. The chair according to claim 1, wherein the backrest is connected to the upper support frame at a position lower than an intermediate position of the backrest in the up-down direction.

4. The chair according to claim 1, wherein the seat is attached to a seat receiving member so that the seat is pushable forward by a seated person when rocking.

* * * * *